US010342393B1

(12) United States Patent
Kirkpatrick

(10) Patent No.: US 10,342,393 B1
(45) Date of Patent: Jul. 9, 2019

(54) TOWEL HOLDING DEVICE AND TOWEL HOLDING SYSTEM THAT INCLUDES THE TOWEL HOLDING DEVICE

(71) Applicant: Solazo, Ltd, Columbus, OH (US)

(72) Inventor: Ronald Dean Kirkpatrick, Columbus, OH (US)

(73) Assignee: Solazo, Ltd, Columbus, OH (US)

( * ) Notice: Subject to any disclaimer, the term of this patent is extended or adjusted under 35 U.S.C. 154(b) by 0 days.

(21) Appl. No.: 15/645,376

(22) Filed: Jul. 10, 2017

Related U.S. Application Data

(60) Provisional application No. 62/362,094, filed on Jul. 14, 2016.

(51) Int. Cl.
*A47K 10/02* (2006.01)
*A47K 10/14* (2006.01)
*A47K 10/04* (2006.01)

(52) U.S. Cl.
CPC ..... *A47K 10/14* (2013.01); *A47K 10/025* (2013.01); *A47K 10/04* (2013.01)

(58) Field of Classification Search
CPC ..... A47K 10/14; A47K 10/10; A47K 10/04; A47K 10/025; A47K 10/12; A47K 10/08; A47K 1/09; A47G 25/0657; A47G 1/06; D06F 57/12; D06F 57/122
USPC ... 248/214, 309.1, 315, 125.7, 205.5, 206.5, 248/309.3, 258.11, 289.11, 346.03, 248/346.06, 314; 211/16, 88.04, 119.009, 211/457
See application file for complete search history.

(56) References Cited

U.S. PATENT DOCUMENTS 1,086,200 A * 2/1914 Michie ..... A45D 27/29 211/16
2,051,068 A * 8/1936 Ayre ..... A47K 10/14 211/16
2,513,846 A * 7/1950 Collins ..... A47K 10/14 248/314
2,613,000 A * 10/1952 Moore ..... A47K 10/14 174/153 G
2,656,043 A * 10/1953 Wold ..... A47K 10/14 211/106

(Continued)

OTHER PUBLICATIONS

GoHook Webpage, Fusionbrands Website, Web page <http://www.fusionbrands.com/products/gohook>, 2 pages, dated Feb. 9, 2014, retrieved from Internet Archive Wayback Machine <https://web.archive.org/web/20140209105949/http://www.fusionbrands.com/products/gohook> on Oct. 16, 2018.

*Primary Examiner* — Nkeisha Smith
(74) *Attorney, Agent, or Firm* — The Law Office of Patrick F. O'Reilly III, LLC

(57) ABSTRACT

A towel holding device configured to support a towel from an object is disclosed herein. The towel holding device includes an attachment mechanism, the attachment mechanism configured to attach the towel holding device to the object; a towel holding member, the towel holding member configured to removably hold the towel in the towel holding device; and a housing portion, the towel holding member being disposed inside of the housing portion, the housing portion configured to be displaceable relative to the attachment mechanism and the towel holding member so that the towel is capable of being inserted into the towel holding device. A towel holding system using the towel holding device is also disclosed herein.

25 Claims, 33 Drawing Sheets

(56) References Cited

U.S. PATENT DOCUMENTS 2,912,117 A * 11/1959 Clay ..... A47K 10/14 211/88.04
3,159,281 A * 12/1964 Hutter ..... A47K 10/12 211/16
3,412,739 A 11/1968 Thatcher
3,755,858 A 9/1973 McPhaul
3,755,859 A 9/1973 Solari
3,879,813 A 4/1975 Shadwell
3,947,927 A 4/1976 Rosenthal
4,103,807 A 8/1978 Lyon et al.
4,194,274 A 3/1980 Garrison
4,536,924 A 8/1985 Willoughby
4,807,334 A 2/1989 Blanchard
4,957,232 A 9/1990 Sprague
5,008,987 A 4/1991 Armour, II
5,020,705 A 6/1991 Garrison
5,074,013 A 12/1991 Arnold et al.
5,076,523 A * 12/1991 Wang ..... A47K 10/10 248/222.14
5,097,996 A 3/1992 Chen
5,131,118 A 7/1992 Breeher
5,142,743 A 9/1992 Hahn
5,485,919 A 1/1996 Samberg et al.
5,546,638 A 8/1996 Chiodaroli
5,611,123 A 3/1997 Prizzi
5,645,167 A 7/1997 Conrad
6,321,920 B1 * 11/2001 Pan ..... A47K 10/10 211/100
6,390,430 B1 5/2002 Hawley et al.
6,477,751 B2 11/2002 Baumdicker et al.
6,547,200 B2 4/2003 Dilworth
6,562,437 B2 5/2003 Bunkley
6,609,640 B1 8/2003 Bokmiller
6,942,190 B1 * 9/2005 Lu ..... F16B 47/00 248/205.5
6,978,918 B2 12/2005 Scanlan et al.
7,086,635 B1 8/2006 Drapeau
7,161,120 B1 1/2007 Stroud et al.
D543,753 S 6/2007 Gunderson
D569,714 S 5/2008 Stewart et al.
D578,382 S 10/2008 Petrocofski
D603,636 S 11/2009 Germany
D683,562 S 6/2013 Izay
2005/0127262 A1 * 6/2005 Holub ..... A63B 55/408 248/314
2005/0283953 A1 12/2005 Jeffrey
2006/0289713 A1 12/2006 Kaplan et al.
2008/0277359 A1 * 11/2008 St. Martin ..... A47K 10/04 211/16
2008/0282515 A1 11/2008 Crevin
2011/0056896 A1 3/2011 Tzekova et al.

* cited by examiner

SECTION A-A

Section View B-B

TOWEL HOLDING DEVICE AND TOWEL HOLDING SYSTEM THAT INCLUDES THE TOWEL HOLDING DEVICE

CROSS-REFERENCE TO RELATED APPLICATIONS

This patent application claims priority to, and incorporates by reference in its entirety, U.S. Provisional Patent Application No. 62/362,094, entitled "Towel Holding Device and Towel Holding System Using the Same", filed on Jul. 14, 2016.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a towel holding device and towel holding system using the same. More particularly, the invention relates to a towel holding device that is configured to support a towel from an object (e.g., a towel rod or the like) and a towel holding system that includes the towel holding device and the towel supported therefrom.

2. Background

In most residential dwellings and many commercial facilities, fabric towels are used in bathrooms and kitchens for various purposes, such as drying hands, drying dishes, etc. These fabric towels are typically draped over towel bars or handles so that they are able to dry before the next use. However, the conventional manner of supporting towels by draping them over towel bars introduces a multitude of problems. First of all, these towels often fall off the towel bar and onto the floor beneath the towel, thereby deleteriously affecting the cleanliness of the towels. Secondly, when draped over a towel bar, it is very difficult to adjust the length of the towel for users having varying towel height requirements (e.g., children with a short stature, people with disabilities, etc.). Thirdly, because towel bars are mounted in fixed locations on walls, the conventional hanging towels are often not located where they are really needed. Finally, because towel bars are often located a substantial distance above the floor, users with a small stature (e.g., children) often pull on the towel in order to use it, which may eventually result in damage to the towel bar, the wall on which the towel bar is mounted, or damage to both the towel bar and the wall.

Therefore, what is needed is a towel holding device that securely grasps the towel being supported thereby so as to maintain the cleanliness of the towel by preventing the towel from falling onto the floor. Moreover, a towel holding device is needed that enables the hanging length of the towel to be readily adjusted so as accommodate the towel height requirements of various users. Furthermore, there is a need for a towel holding device that is capable of being readily positioned in virtually any location where a user needs to use a towel. In addition, a towel holding device is needed that helps to prevent damage to the towel bar and/or the wall on which the towel bar is mounted. Also, there is a need for a towel holding device that enables the towel to be more readily accessible, particularly for children and those individuals with disabilities. Further, there is a need for a towel holding system that includes the towel holding device that is able to achieve one or more of the aforesaid objectives.

BRIEF SUMMARY OF EMBODIMENTS OF THE INVENTION

Accordingly, the present invention is directed to a towel holding device and towel holding system using the same that substantially obviates one or more problems resulting from the limitations and deficiencies of the related art.

In accordance with one or more embodiments of the present invention, there is provided a towel holding device configured to support a towel from an object. The towel holding device includes an attachment mechanism, the attachment mechanism configured to attach the towel holding device to the object; a towel holding member, the towel holding member configured to removably hold the towel in the towel holding device; and a housing portion, the towel holding member being disposed inside of the housing portion, the housing portion configured to be displaceable relative to the attachment mechanism and the towel holding member so that the towel is capable of being inserted into the towel holding device.

In a further embodiment of the present invention, the attachment mechanism comprises an upper ring portion and a cylindrical base portion, the upper ring portion of the attachment mechanism configured to be attached to the object, and the cylindrical base portion of the attachment mechanism configured to be attached to the towel holding member.

In yet a further embodiment, the cylindrical base portion of the attachment mechanism is divided into two half sections such that an interior of the upper ring portion is capable of being accessed, thereby permitting the attachment mechanism to be wrapped around a portion of the object and the towel holding device to be secured to the object.

In still a further embodiment, the cylindrical base portion of the attachment mechanism further comprises a connecting projection extending outwardly from an outer surface of the cylindrical base portion, the connecting projection of the cylindrical base portion configured to be removably attached to a cavity disposed in the towel holding member in a snap-fit type engagement such that the attachment mechanism is capable of being selectively attached and detached from the towel holding member by a user.

In yet a further embodiment, the upper ring portion of the attachment mechanism comprises an elastically deformable material so that the upper ring portion is capable of being elastically deformed when the portion of the object is being inserted into the interior of the upper ring portion.

In still a further embodiment, at least one portion of the upper ring portion of the attachment mechanism is separable from another portion of the upper ring portion such that an interior of the upper ring portion is capable of being accessed, thereby permitting the attachment mechanism to be wrapped around a portion of the object and the towel holding device to be secured to the object.

In yet a further embodiment, the upper ring portion of the attachment mechanism comprises a fastener member configured to removably attach the separable portions of the upper ring portion to one another.

In still a further embodiment, the fastener member of the upper ring portion comprises one or more magnets for magnetically attaching the separable portions of the upper ring portion to one another, the one or more magnets configured to allow a detachment of the separable portions of the upper ring portion when a force exceeding a predetermined amount is applied to the towel so as to form a breakaway connection for preventing damage to the object to which the towel holding device is attached.

In yet a further embodiment, the attachment mechanism comprises a strap member attached to a cylindrical base portion, the strap member of the attachment mechanism configured to be attached to the object, and the cylindrical base portion of the attachment mechanism configured to be attached to the towel holding member.

In still a further embodiment, at least one portion of the strap member of the attachment mechanism is separable from another portion of the strap member such that an interior of the strap member is capable of being accessed, thereby permitting the attachment mechanism to be wrapped around a portion of the object and the towel holding device to be secured to the object.

In yet a further embodiment, the strap member of the attachment mechanism comprises one or more fastener members configured to removably attach the separable portions of the strap member to one another.

In still a further embodiment, the attachment mechanism comprises an upper loop portion and a lower base portion, the upper loop portion of the attachment mechanism comprising a pair of spaced-apart downwardly extending arms, and the lower base portion of the attachment mechanism comprising a pair of spaced-apart upwardly extending arms that correspond to the downwardly extending arms of the upper loop portion, the downwardly extending arms of the upper loop portion configured to be removably attached to the upwardly extending arms of the lower base portion such that an interior of the upper loop portion is capable of being accessed, thereby permitting the attachment mechanism to be engaged with the object and the towel holding device to be secured to the object.

In yet a further embodiment, the upper loop portion of the attachment mechanism further comprises at least one release device coupled to one of the downwardly extending arms, the at least one release device configured to disengage the one of the downwardly extending arms of the upper loop portion from a respective one of the upwardly extending arms of the lower base portion so as to enable the interior of the upper loop portion to be accessed and the attachment mechanism to be engaged with the object.

In still a further embodiment, the attachment mechanism of the towel holding device is provided with a plurality of interchangeable upper loop portions of different sizes so as to enable the towel holding device to be attached to different objects having various sizes.

In yet a further embodiment, the towel holding member is in the form of a tongue member, the tongue member including an upper cylindrical portion configured to be attached to the attachment mechanism and a lower base portion configured to engage the towel when the towel is being held in the towel holding device, the lower base portion of the tongue member flared outwardly relative to the upper cylindrical portion of the tongue member.

In still a further embodiment, the towel holding device further comprises a spring member or a spring-like mechanism, the spring member or spring-like mechanism being disposed around, or proximate to the upper cylindrical portion of the tongue member, and the spring member or spring-like mechanism configured to bias the tongue member in an engaged position with the towel.

In yet a further embodiment, the tongue member comprises at least one tab member for supporting an end of the spring member or spring-like mechanism.

In still a further embodiment, the housing portion comprises a front housing portion and a rear housing portion, at least one of the front housing portion and the rear housing portion comprising an aperture for receiving the towel therein.

In yet a further embodiment, each of the front housing portion and the rear housing portion comprises a respective aperture formed therein for allowing a passage of the towel through oppositely disposed sides of towel holding device.

In still a further embodiment, each of the front housing portion and the rear housing portion comprises an upper collar portion and a lower base portion, the lower base portion of each of the front and rear housing portions flared outwardly relative to the upper collar portion of each of the front and rear housing portions, and the lower base portions of the front and rear housing portions forming a substantially flat floor configured to hold the towel.

In yet a further embodiment, the substantially flat floor comprises a plurality of ribs spaced apart thereon for retaining the towel in the towel holding device.

In still a further embodiment, the upper collar portion of at least one of the front and rear housing portions comprises an abutment configured to limit the movement of the front and rear housing portions relative to the towel holding member.

In yet a further embodiment, at least one of the front and rear housing portions comprises a plurality of spaced-apart ribs for increasing a structural rigidity of the at least one of the front and rear housing portions.

In accordance with one or more other embodiments of the present invention, there is provided a towel holding system that includes a towel and a towel holding device supporting the towel from an object. The towel holding device includes an attachment mechanism, the attachment mechanism configured to attach the towel holding device to the object; a towel holding member, the towel holding member removably holding the towel in the towel holding device; and a housing portion, the towel holding member being disposed inside of the housing portion, the housing portion configured to be displaceable relative to the attachment mechanism and the towel holding member so that the towel is capable of being inserted into the towel holding device.

In a further embodiment of the present invention, the attachment mechanism of the towel holding device is removably attached to the towel holding member of the towel holding device by means of a snap-fit type engagement.

In yet a further embodiment, the attachment mechanism of the towel holding device is configured to rotate relative to the towel holding member and the housing portion.

In still a further embodiment, the attachment mechanism of the towel holding device is configured to rotate 360 degrees relative to the towel holding member and the housing portion.

In yet a further embodiment, the towel holding device further comprises a spring member or spring-like mechanism, and, when a downward force is applied to the housing portion by a user, the spring member or spring-like mechanism is configured to be compressed, and the housing portion is configured to be displaced relative to the attachment mechanism and the towel holding member.

In still a further embodiment, the housing portion of the towel holding device comprises an elevated floor member disposed therein, the elevated floor member being spaced-apart from a bottom wall of the housing portion, and the towel holding member configured to rest against an upper surface of the elevated floor member.

In yet a further embodiment, the towel holding member of the towel holding device forms a breakaway connection with the towel so that, if a force exceeding a predetermined amount is applied to the towel, the towel is configured to be released from the towel holding member without damage being sustained to the towel holding device, the object, or the attachment site.

In still a further embodiment, the object to which the towel holding device is attached comprises one of: (i) a towel rod, (ii) a refrigerator handle, (iii) a cabinet handle, (iv) a cabinet knob, (v) a wall hook, (vi) an oven door, (vii) a microwave handle, (viii) a mirror, and (ix) a door knob.

In yet a further embodiment, the attachment mechanism of the towel holding device comprises a cylindrical attachment member and a suction cup base portion, the suction cup base portion configured to be attached to the object, and the cylindrical attachment member of the attachment mechanism configured to be coupled to the towel holding member.

In still a further embodiment, the attachment mechanism of the towel holding device comprises an upper ring portion and a cylindrical base portion, the upper ring portion of the attachment mechanism configured to be attached to the object, and the cylindrical base portion of the attachment mechanism configured to be attached to the towel holding member; and wherein at least one portion of the upper ring portion of the attachment mechanism is separable from another portion of the upper ring portion such that an interior of the upper ring portion is capable of being accessed, thereby permitting the attachment mechanism to be wrapped around a portion of the object and the towel holding device to be secured to the object.

In yet a further embodiment, the separable portions of the upper ring portion of the towel holding device are each formed from an elastically deformable material so that the separable portions of the upper ring portion are capable of being elastically deformed when a portion of the object is inserted into the interior of the upper ring portion.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 9:
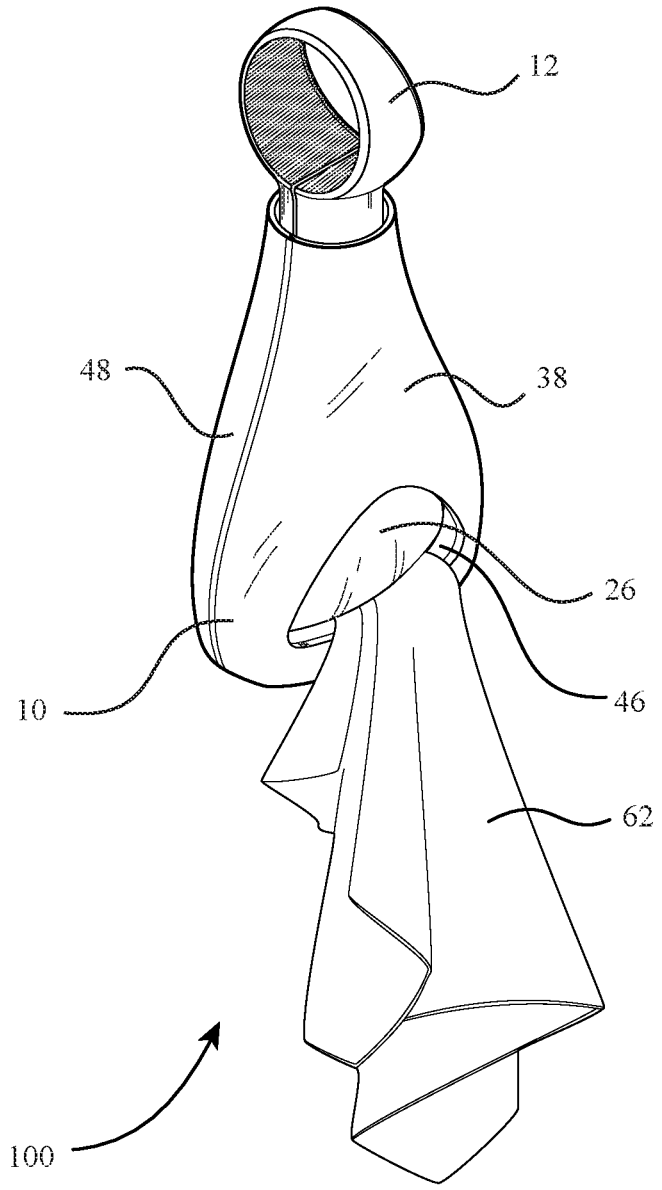
FIG. 9 is a perspective view of a towel holding system comprising the towel holding device of FIG. 1, according to one embodiment of the invention, wherein the towel is only disposed through the towel aperture in the front housing portion of the device.
Figure 15:
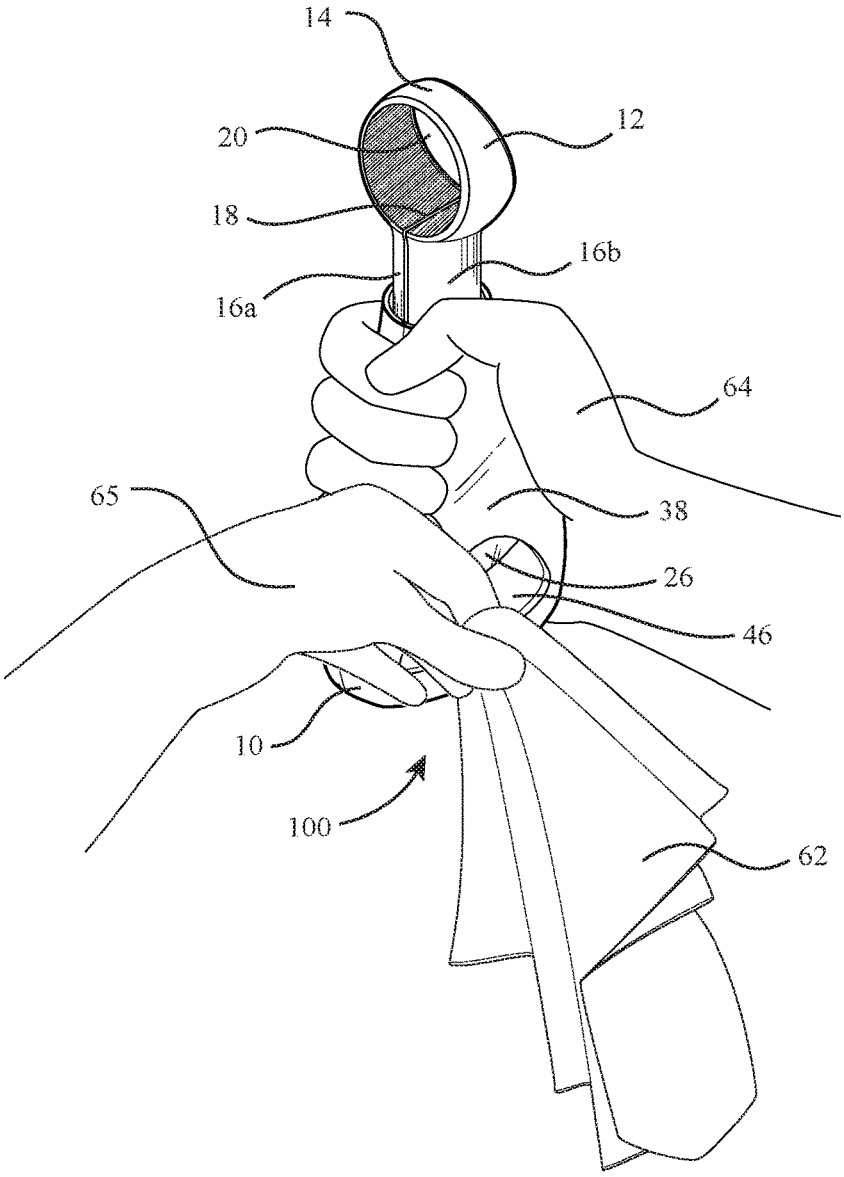
FIG. 15 is yet another perspective view of the towel holding system of FIG. 9, wherein a user is grasping and pulling down on the housing of the towel holding device so that a towel may be inserted therein.
Figure 16:
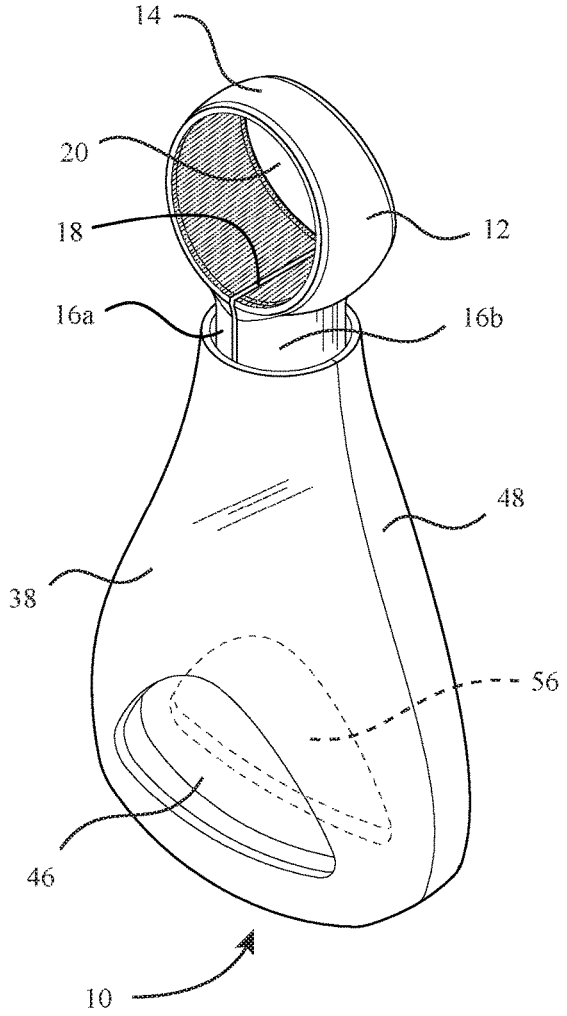
FIG. 16 is yet another perspective view of the towel holding device of FIG. 1, wherein the towel apertures in the front and rear housing portions are illustrated.
Figure 18:
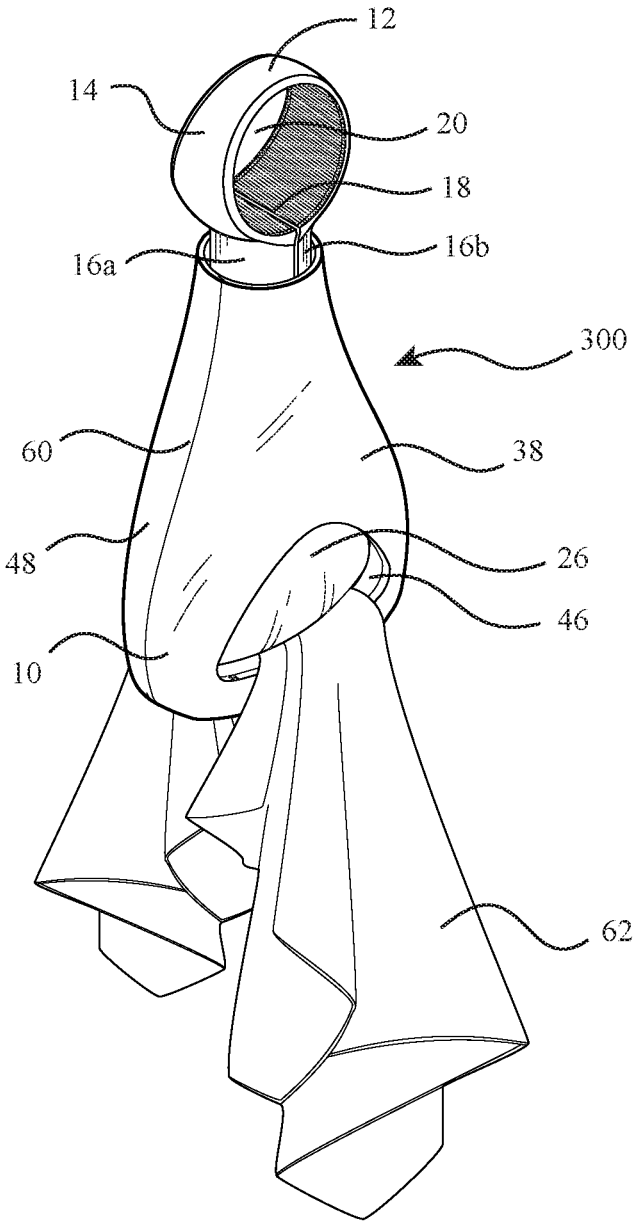
FIG. 18 is a perspective view of yet another towel holding system comprising the towel holding device of FIG. 1, according to yet another embodiment of the invention, wherein the towel is disposed through the towel apertures in both the front and rear housing portions of the device.

An illustrative embodiment of a towel holding system is seen generally at 100 in FIG. 9. As shown in this figure, the towel holding system 100 generally comprises a towel 62 and a towel holding device 10 configured to support the towel from an object (e.g., a towel hook or towel rod). In the illustrative embodiment, it can be seen that the towel holding device 10 includes an attachment mechanism (e.g., an attachment ring 12), the attachment ring 12 configured to attach the towel holding device to the object; a towel holding member (e.g., tongue member 26), the tongue member 26 removably holding the towel 62 in the towel holding device 10; and a housing portion 38, 48, the tongue member 26 being disposed inside of the housing portion 38, 48. As will be described in more detail hereinafter, the housing portion 38, 48 is configured to be displaceable relative to the attachment ring 12 and the tongue member 26 so that the towel 62 is capable of being inserted into the towel holding device 10 (e.g., as shown in FIG. 15). In the illustrative embodiment of FIG. 9, the towel 62 is only disposed through the towel aperture 46 in the front housing portion 38 of the device 10. As will be explained below, the towel 62 may also be disposed through the towel apertures 46, 56 in both the front and rear housing portions 38, 48 of the device 10 (e.g., as illustrated in FIG. 18). Each of the constituent components of the towel holding device 10 will be described in detail hereinafter.

Figure 1:
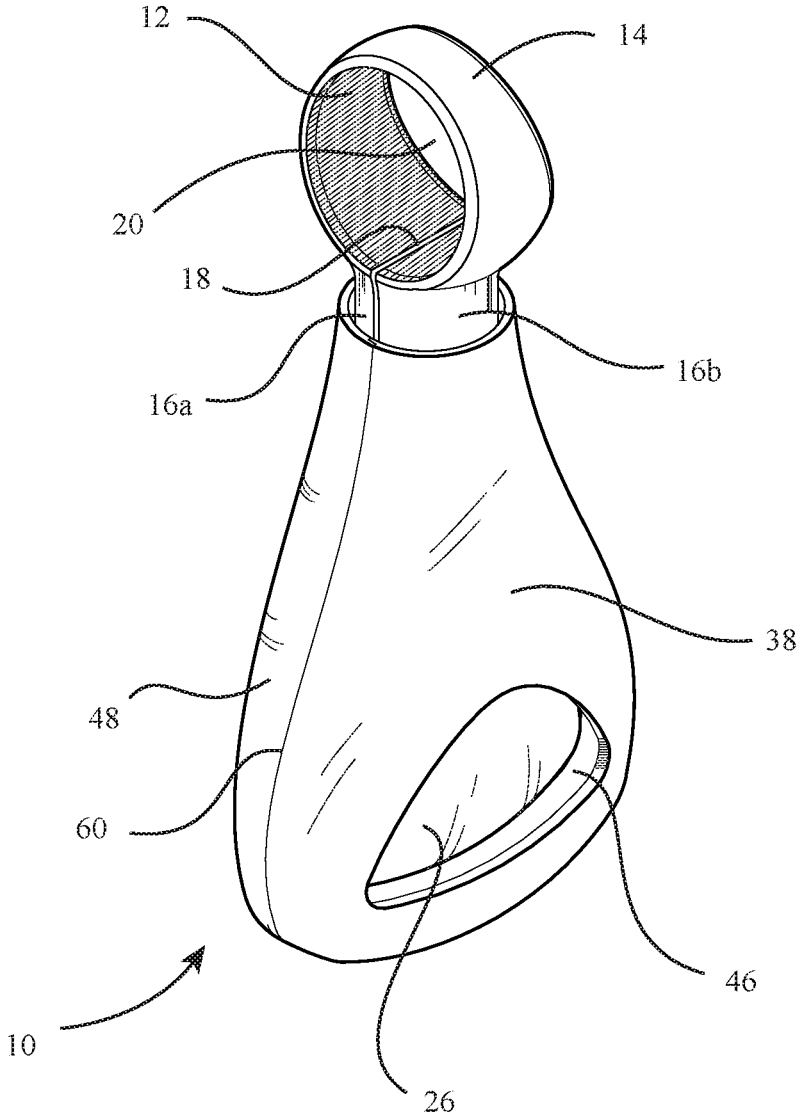
FIG. 1 is a perspective view of a towel holding device, according to one embodiment of the invention.
Figure 2:
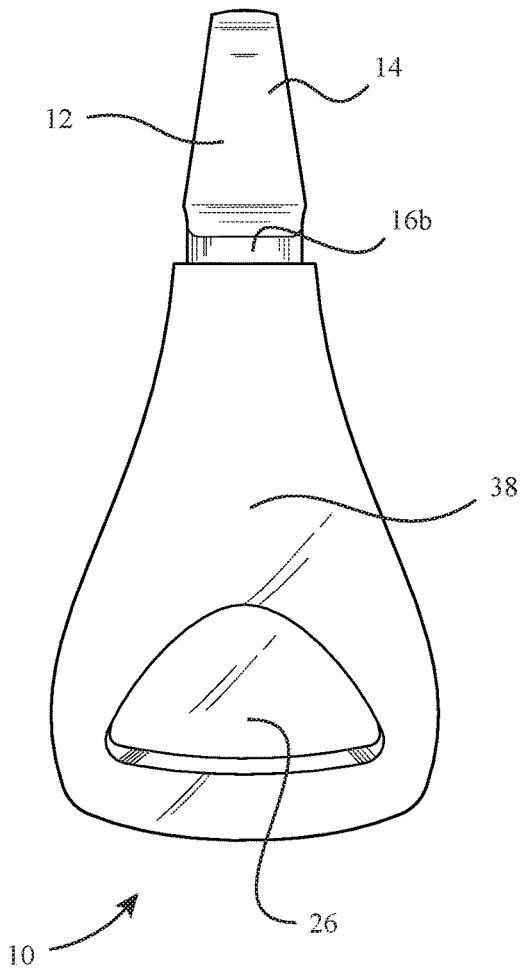
FIG. 2 is a front elevational view of the towel holding device of FIG. 1, wherein the attachment ring of the towel holding device is disposed in a first position.
Figure 7:
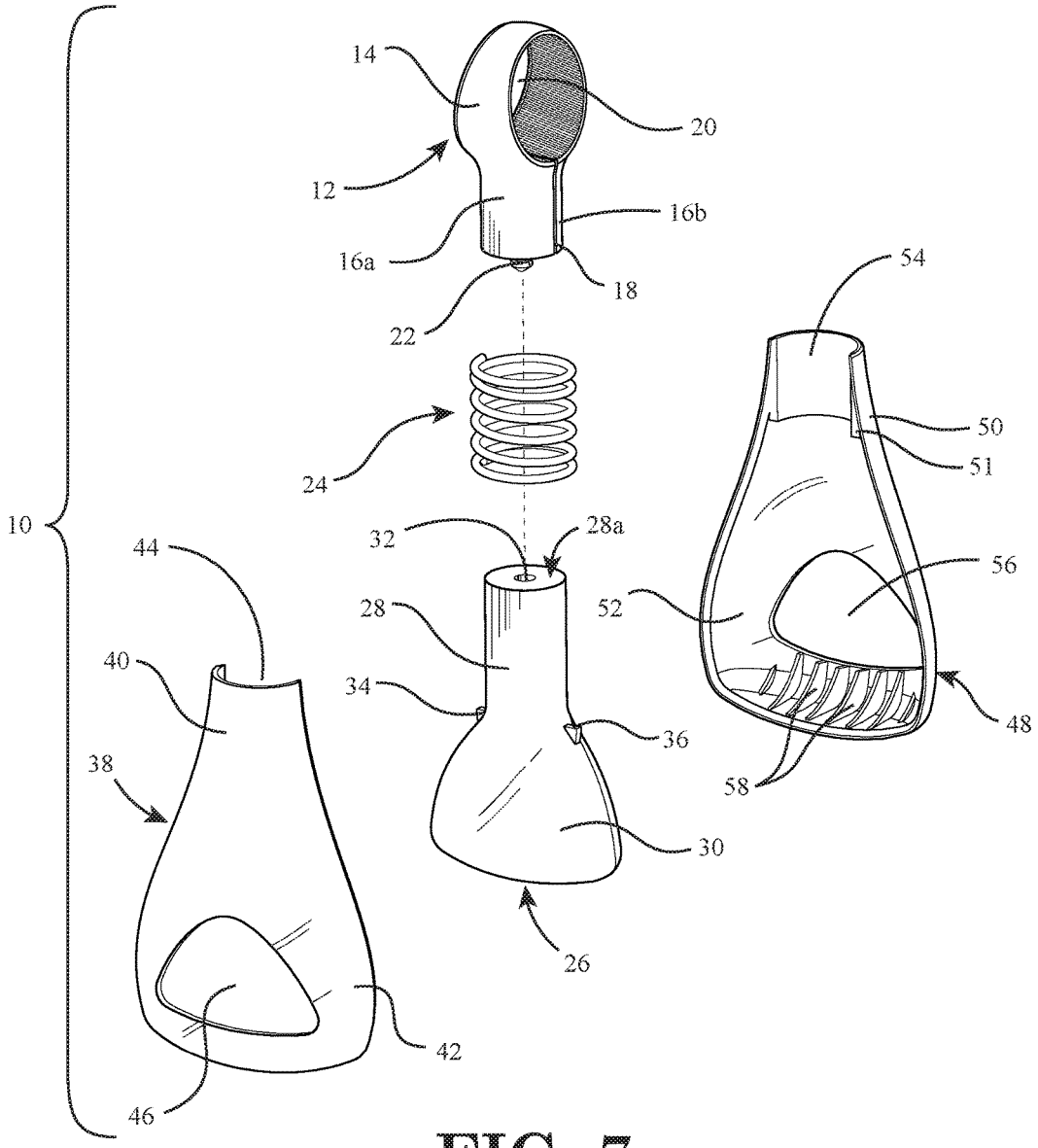
FIG. 7 is an exploded perspective view of the towel holding device of FIG. 1.
Figure 8:
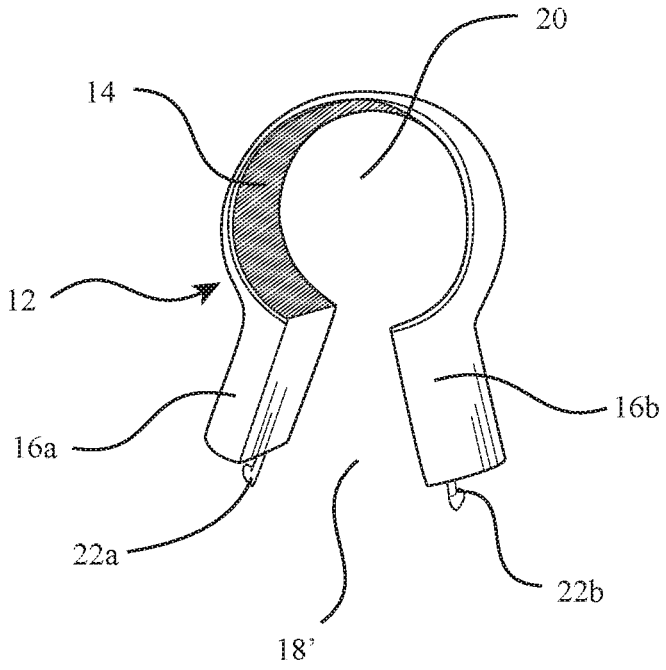
FIG. 8 is a perspective view of the attachment ring of the towel holding device of FIG. 1, wherein the cylindrical base portion of the attachment ring has been pulled apart so that the attachment ring is capable of being engaged with an object.

Initially, with reference to FIGS. 1, 7, and 8, one illustrative embodiment of the attachment mechanism (e.g., an attachment ring 12) of the towel holding device 10 will be explained. As particularly shown in the exploded view of FIG. 7, the attachment ring 12 includes an upper ring portion 14 and a cylindrical base portion 16*a*, 16*b*. The upper ring portion 14 of the attachment ring 12 is configured to be attached to an object (e.g., a towel hook or towel rod). The cylindrical base portion 16*a*, 16*b* of the attachment ring 12 is configured to be attached to the tongue member 26 of the towel holding device 10. As best shown in FIG. 8, the cylindrical base portion 16*a*, 16*b* of the attachment ring 12 is divided into two half sections 16*a*, 16*b* such that an interior 20 of the upper ring portion 14 is capable of being accessed, thereby permitting the attachment ring 12 to be wrapped around a portion of the object (e.g., a portion of the towel hook or towel rod) and the towel holding device 10 to be secured to the object. In FIG. 7, it can be seen that the first and second half sections 16*a*, 16*b* of the cylindrical base portion are spaced apart by a gap 18 (i.e., the gap 18 extends in a longitudinal direction of the cylindrical base portion and separates the first and second half sections 16*a*, 16*b* from one another). When the first and second half sections 16*a*, 16*b* of the cylindrical base portion are separated from one another by a user, an increased gap 18' between the half sections 16*a*, 16*b* is formed (see FIG. 8) so that the attachment ring 12 can be wrapped around the portion of the object (e.g., the portion of the towel hook or towel rod). With combined reference to FIGS. 7 and 8, it can be seen that the cylindrical base portion 16*a*, 16*b* of the attachment ring 12 further comprises a connecting projection (with nipple portion 22) extending downwardly from the bottom surface of the cylindrical base portion 16*a*, 16*b*. As best illustrated in the longitudinal sectional views in FIGS. 19 and 20, the nipple portion 22 of the connecting projection is attached to the bottom surface of the cylindrical base portion 16*a*, 16*b* by means of shaft portion 21. Like the cylindrical body of the cylindrical base portion 16*a*, 16*b*, the nipple portion 22 of the connecting projection is divided into first and half sections 22*a*, 22*b* (see FIG. 8) so that the object (e.g., a portion of the towel hook or towel rod) to which the attachment ring 12 is secured is capable of being inserted into the interior 20 of the upper ring portion 14. Referring again to FIGS. 19 and 20, it can be seen that the connecting projection 21, 22 of the cylindrical base portion 16*a*, 16*b* is configured to be removably attached to a cavity 33 disposed in the upper cylindrical portion 28 of the tongue member 26 of the towel holding device 10 in a snap-fit type engagement such that the attachment ring 12 is capable of being selectively attached and detached from the tongue member 26 by a user of the towel holding device 10. That is, when engaging the connecting projection 21, 22 of the cylindrical base portion 16*a*, 16*b* of the attachment ring 12 with the upper cylindrical portion 28 of the tongue member 26, the connecting projection 21, 22 is pressed into the aperture 32 disposed in the top surface 28*a* of the upper cylindrical portion 28 of the tongue member 26 by a user (refer to FIG. 7) until the nipple portion 22 of the connecting projection snaps into place within the cavity 33 of the tongue upper cylindrical portion 28 (see FIGS. 19 and 20). Because the base of the nipple portion 22 of the connecting projection has an outer diameter that is larger than the diameter of the aperture 32 disposed in the top surface 28*a* of the upper cylindrical portion 28, the attachment ring 12 is removably affixed to the tongue member 26 of the towel holding device 10 by means of the engagement between the nipple portion 22 and the aperture 32. As best shown in the longitudinal sectional views of FIGS. 19 and 20, the outer diameter of the shaft portion 21 of the connecting projection is approximately equal to the diameter of the aperture 32 in the upper cylindrical portion 28 of the tongue member 26.

In the illustrative embodiment, the upper ring portion 14 of the attachment ring 12 comprises an elastically deformable material (e.g., the upper ring portion 14 is formed from an elastically deformable polymeric material or plastic) so that the upper ring portion 14 is capable of being elastically deformed when the portion of the object (e.g., the portion of the towel hook or towel rod) is being inserted into the interior 20 of the upper ring portion 14. Similarly, in the illustrative embodiment, the connecting projection 21, 22 of the cylindrical base portion 16*a*, 16*b* of the attachment ring 12 comprises an elastically deformable material (e.g., the connecting projection 21, 22 is formed from an elastically deformable polymeric material or plastic) so that the nipple portion 22 of the connecting projection 21, 22 is capable of being elastically deformed when the nipple portion 22 is inserted into the aperture 32 in the upper cylindrical portion 28 of the tongue member 26.

Figure 21:
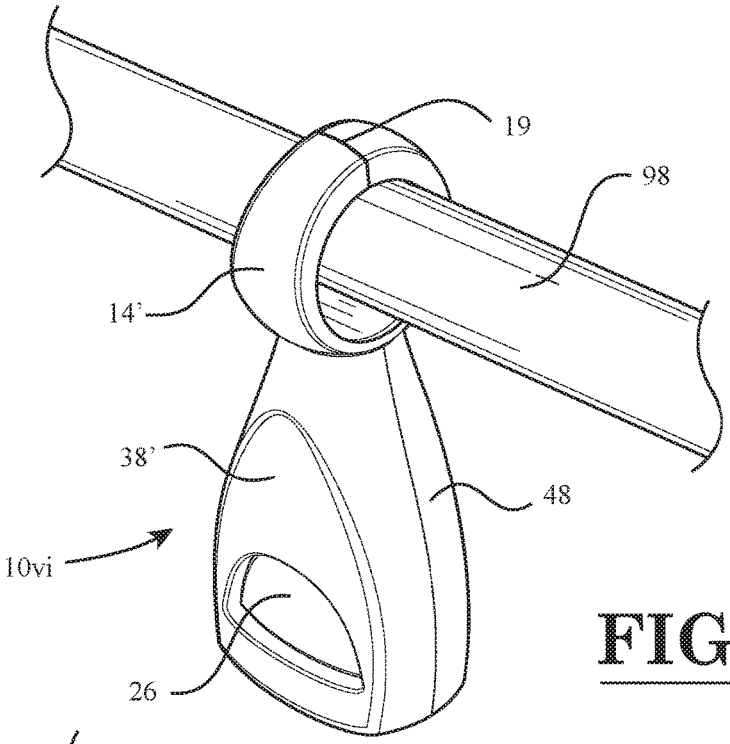
FIG. 21 is a perspective view of still another towel holding device, according to still another embodiment of the invention, wherein the towel holding device of FIG. 21 is similar in most respects to the towel holding device of FIG. 1 except that the towel holding device is provided with a magnetic attachment ring, the magnetic attachment ring of the towel holding device in FIG. 21 is disposed in an engaged position.
Figure 22:
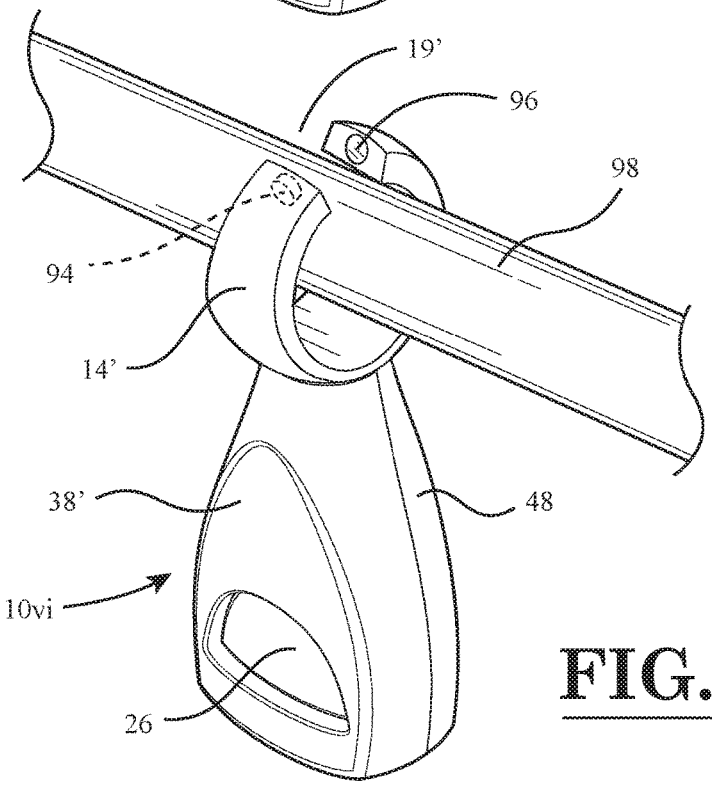
FIG. 22 is another perspective view of the towel holding device of FIG. 21, wherein the magnetic attachment ring of the towel holding device in FIG. 22 is disposed in an open position.
Figure 23:
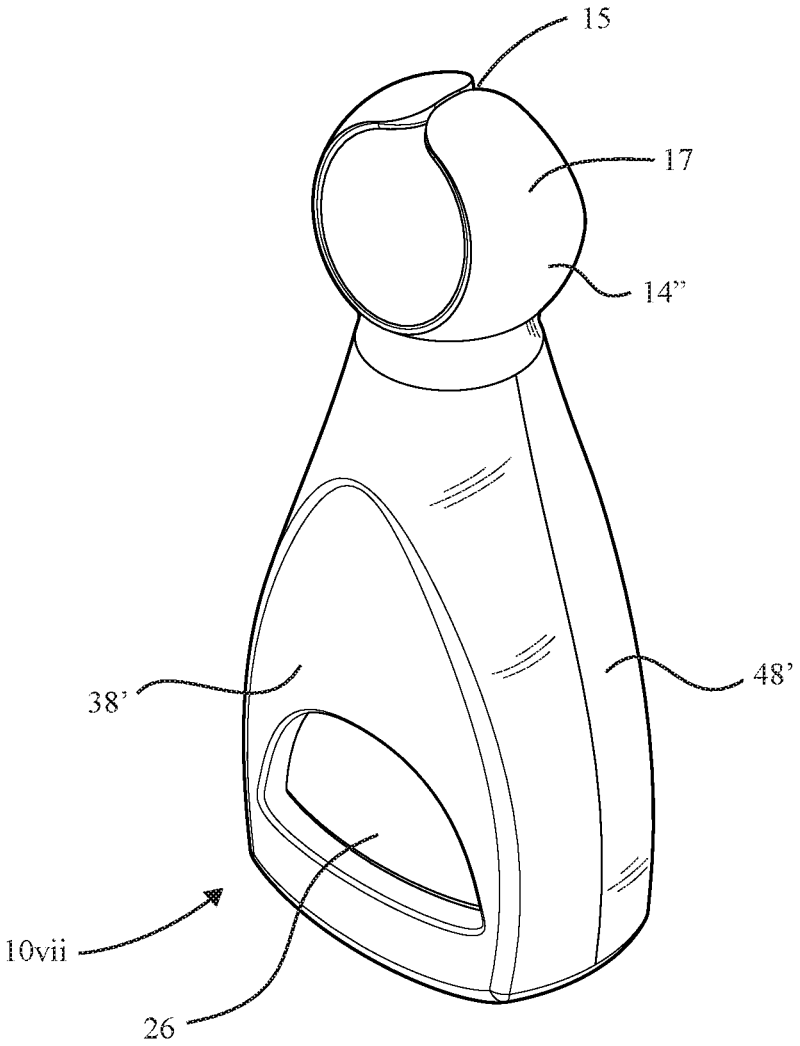
FIG. 23 is a front-side perspective view of another towel holding device, according to still another embodiment of the invention, wherein the towel holding device of FIG. 23 is similar in most respects to the towel holding device of FIG. 1 except that the towel holding device is provided with an elastically deformable attachment ring.
Figure 24:
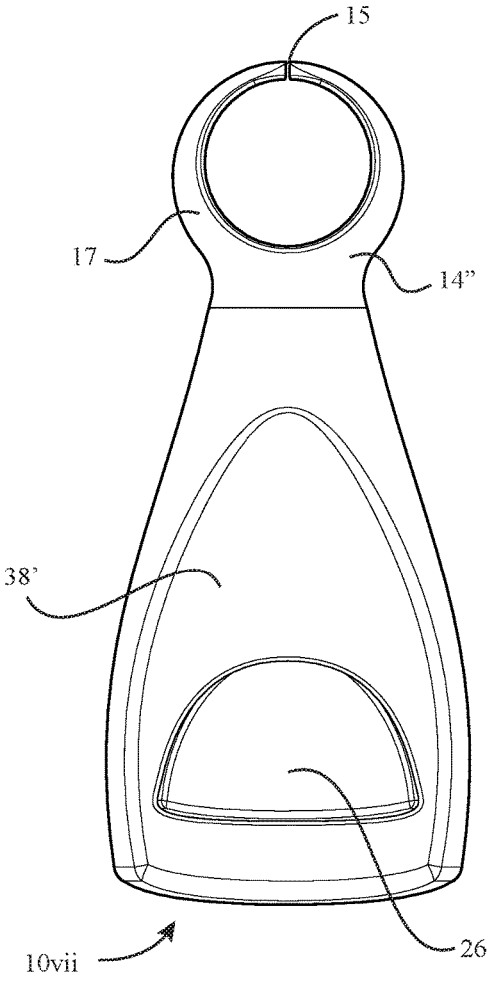
FIG. 24 is a front elevational view of the towel holding device of FIG. 23.
Figure 25:
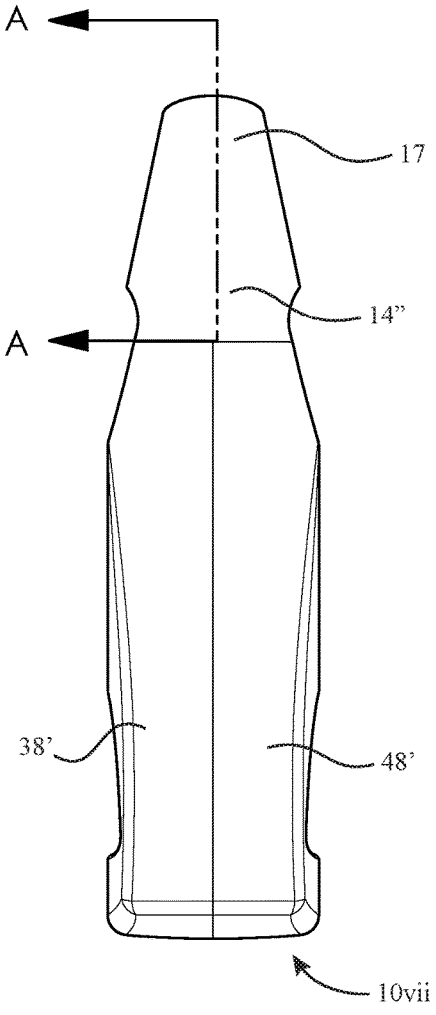
FIG. 25 is a side view of the towel holding device of FIG. 23.
Figure 26:
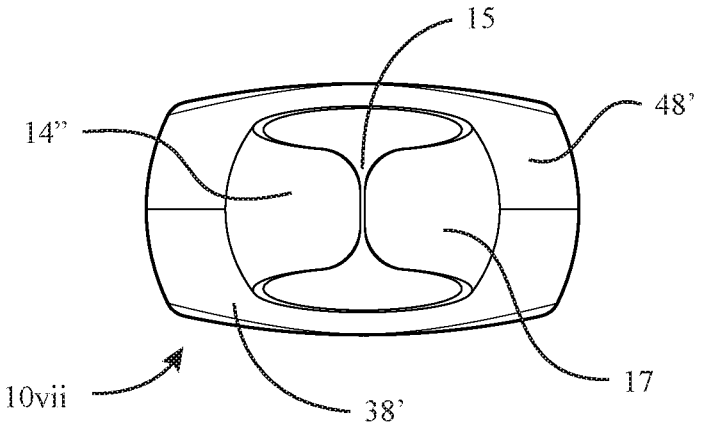
FIG. 26 is a top plan view of the towel holding device of FIG. 23.
Figure 27:
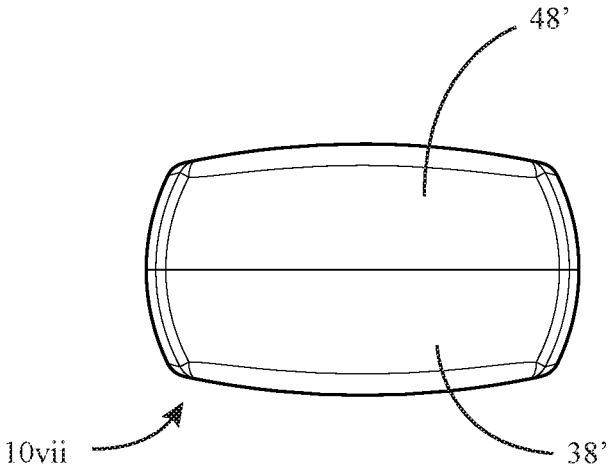
FIG. 27 is a bottom plan view of the towel holding device of FIG. 23.
Figure 28:
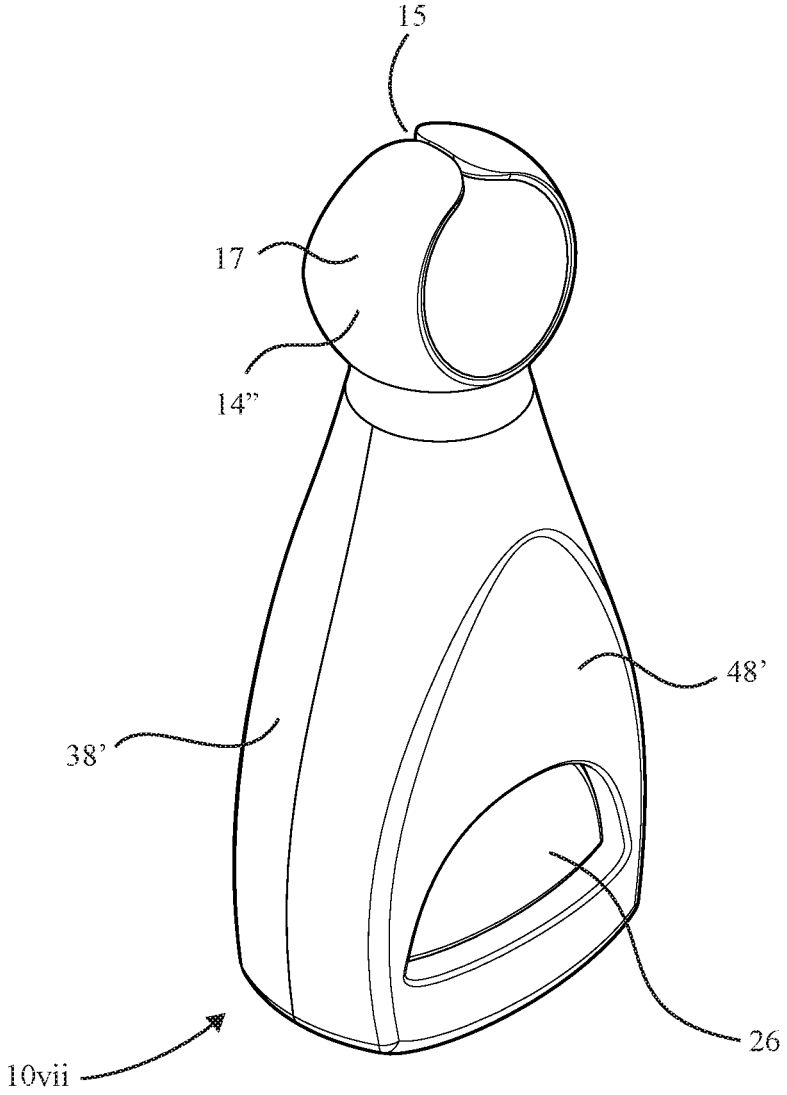
FIG. 28 is a rear-side perspective view of the towel holding device of FIG. 23.
Figure 29:
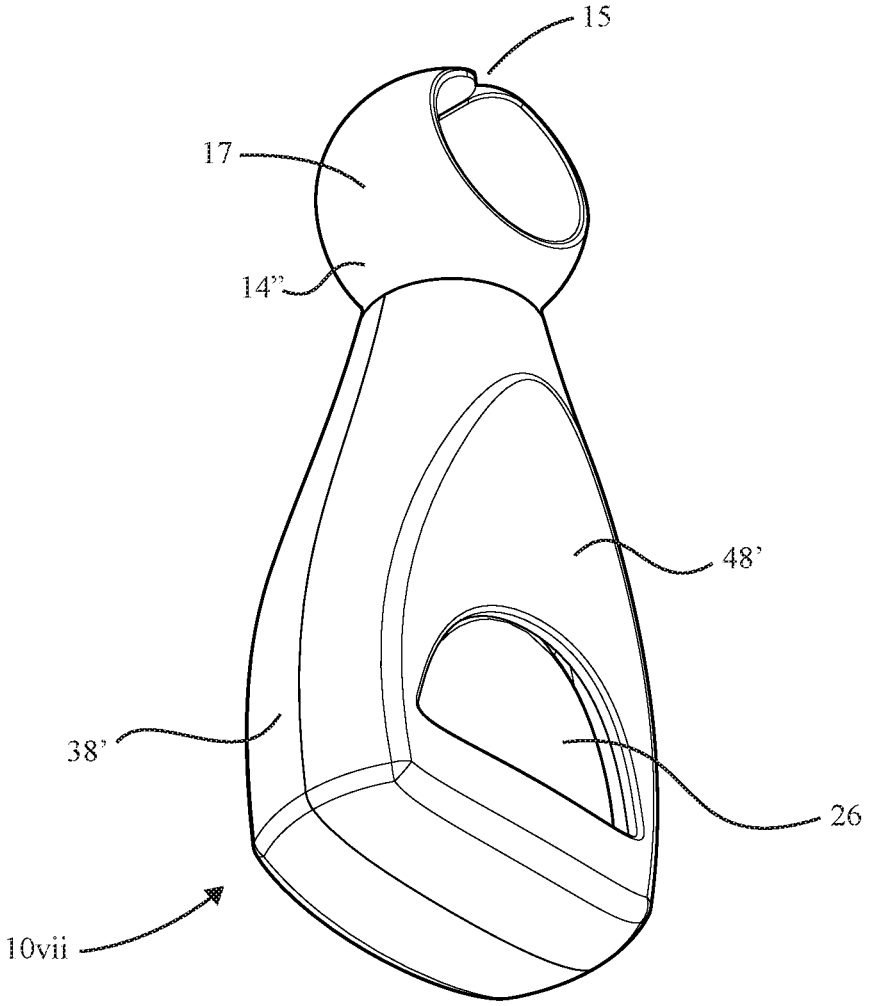
FIG. 29 is a bottom-rear perspective view of the towel holding device of FIG. 23.
Figure 30:
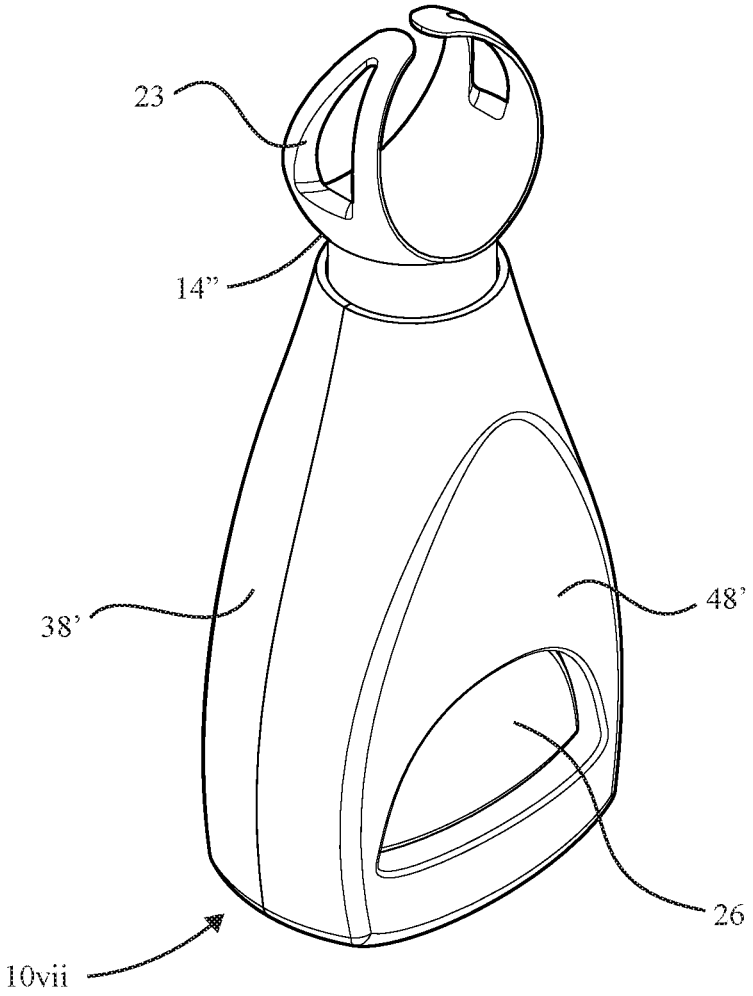
FIG. 30 is another rear-side perspective view of the towel holding device of FIG. 23, wherein the outer cover of the attachment ring has been removed in order to illustrate the inner support structure of the attachment ring.
Figure 31:
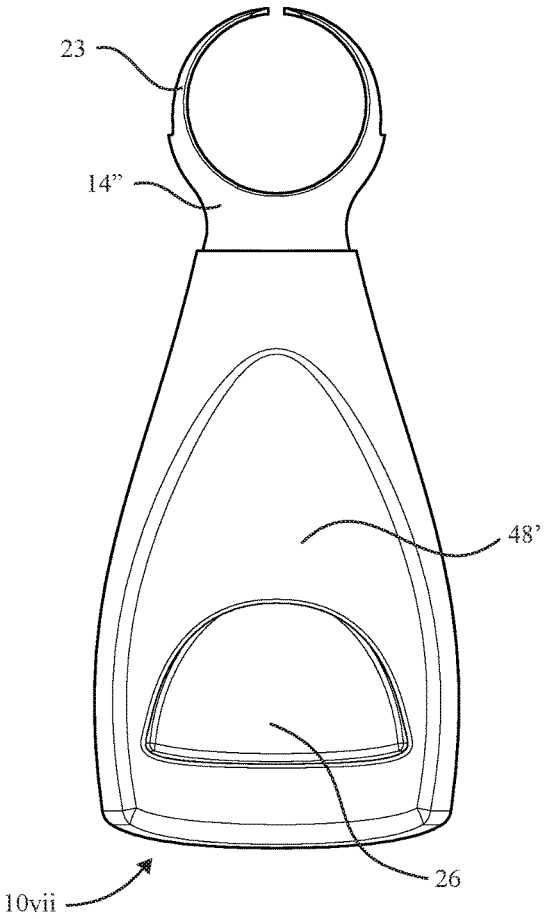
FIG. 31 is a rear elevational view of the towel holding device of FIG. 30, which has the outer cover of the attachment ring removed.
Figure 32:
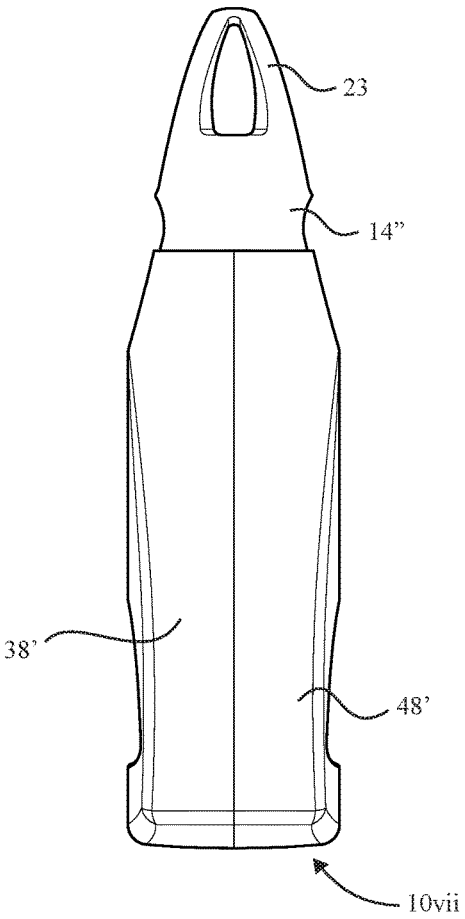
FIG. 32 is a side view of the towel holding device of FIG. 30, which has the outer cover of the attachment ring removed.
Figure 33:
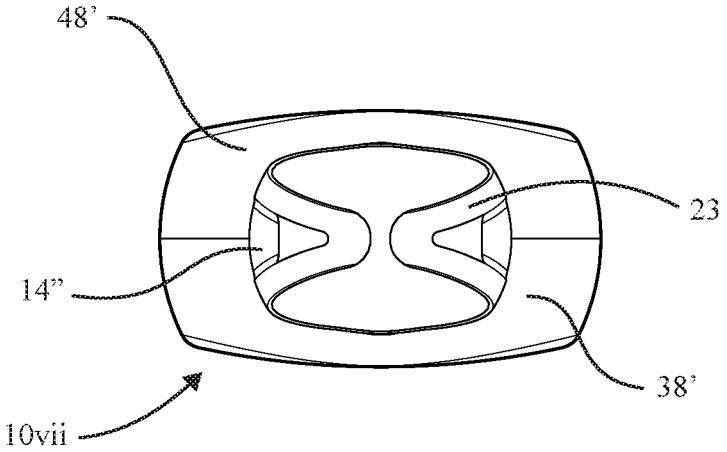
FIG. 33 is a top plan view of the towel holding device of FIG. 30, which has the outer cover of the attachment ring removed.
Figure 34:
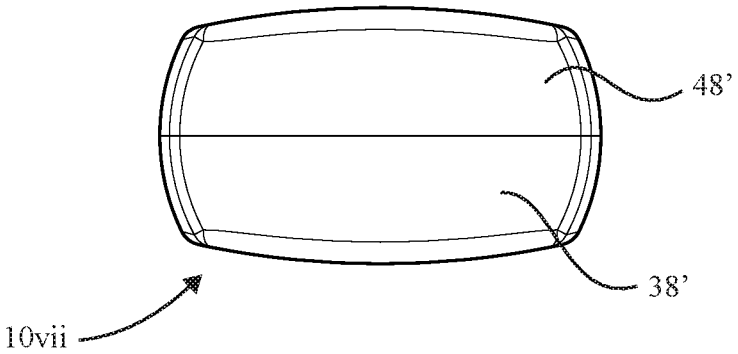
FIG. 34 is a bottom plan view of the towel holding device of FIG. 30, which has the outer cover of the attachment ring removed.
Figure 35:
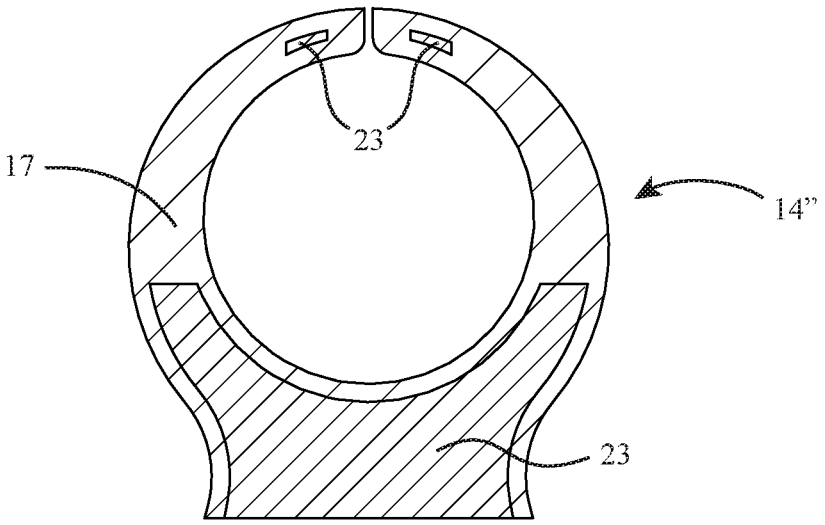
FIG. 35 is a partial longitudinal sectional view of the attachment ring of the towel holding device of FIG. 25, wherein the sectional view is generally cut along the cutting-plane line A-A in FIG. 25.
Figure 36:
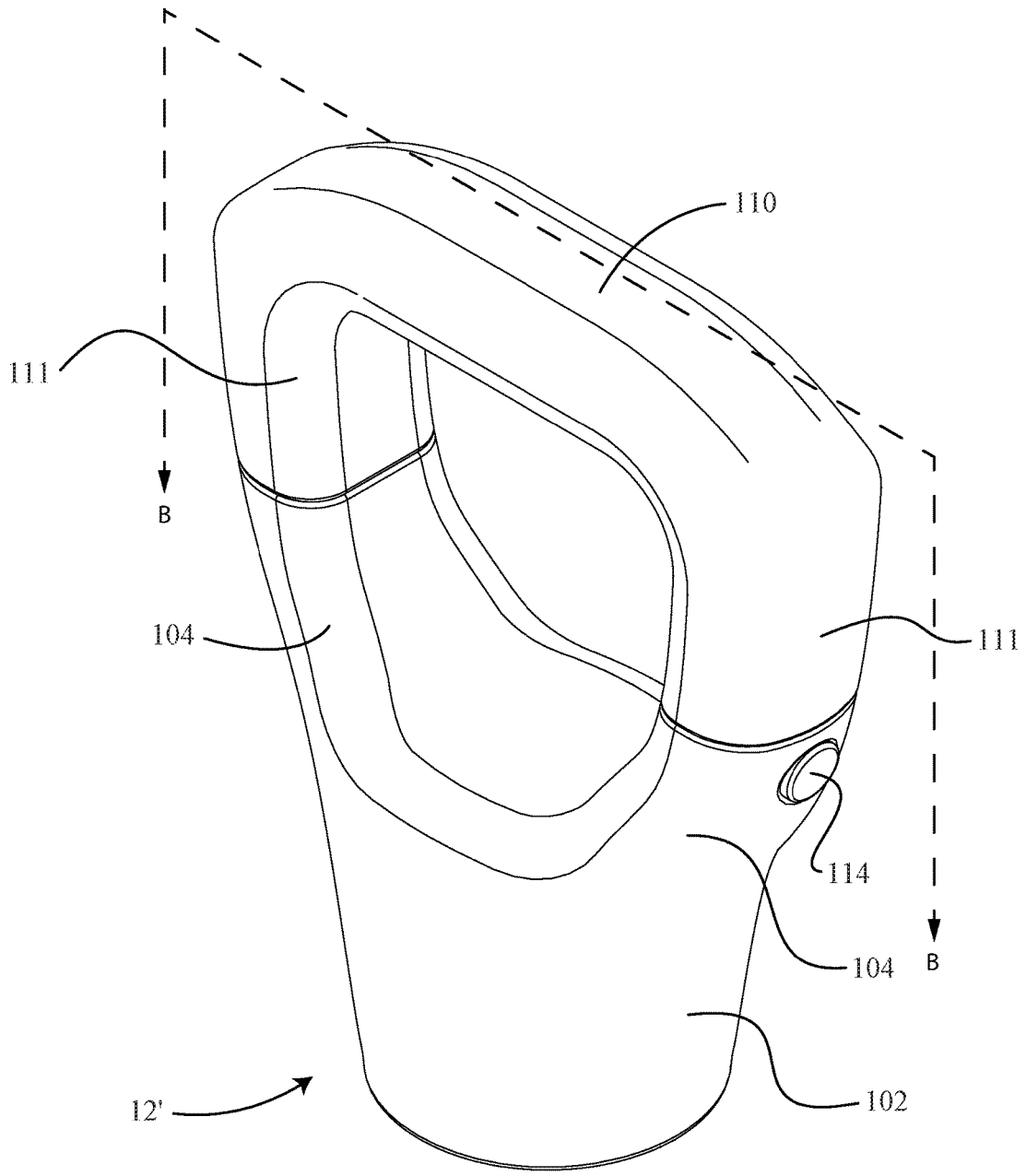
FIG. 36 is a perspective view of an alternative embodiment of the attachment ring of the towel holding device described herein, wherein the attachment ring is provided with a breakaway connection.

An alternative illustrative embodiment of the attachment mechanism of the towel holding device 10*vi* will be described with reference to FIGS. 21 and 22. As shown in these figures, the alternative attachment mechanism comprises an upper ring portion 14' that is capable of being opened at the top thereof so that the towel holding device 10*vi* can be secured to an object (e.g., a towel rod 98). That is, as illustrated in FIGS. 21 and 22, at least one portion of the upper ring portion 14' of the alternative attachment mechanism is separable from another portion of the upper ring portion 14' such that an interior of the upper ring portion 14' is capable of being accessed, thereby permitting the attachment mechanism to be wrapped around a portion of an object (e.g., a portion of the towel rod 98 in FIGS. 21 and 22) and the towel holding device 10*vi* to be secured to the object (i.e., to the towel rod 98 of FIGS. 21 and 22). In FIG. 21, it can be seen that the separable sections of the upper ring portion 14' are spaced apart by a gap 19 (i.e., the gap 19 separates the sections of the upper ring portion 14' from one another). When the sections of the upper ring portion 14' are separated from one another by a user, an increased gap 19' between the ring sections is formed so that the attachment ring can be wrapped around the portion of the object (e.g., the portion of the towel rod 98 in FIGS. 21 and 22). With reference to FIG. 22, it can be seen that the upper ring portion 14' of the alternative attachment mechanism comprises a fastener member 94, 96 configured to removably attach the separable portions of the upper ring portion 14' to one another. More particularly, in the illustrative embodiment, the fastener member of the upper ring portion 14' comprises magnets 94, 96 (e.g., with adjoining north and south poles) for magnetically attaching the separable portions of the upper ring portion 14' to one another. In another embodiment, the first section of the separable upper ring portion 14' may comprise a magnet and the second section of the separable upper ring portion 14' may comprises a metallic material (i.e., a metal disc formed from iron) that is magnetically attracted to the magnet on the first section.

Similar to that described above for the upper ring portion 14 of the attachment ring 12, in the illustrative embodiment, the upper ring portion 14' of the alternative attachment mechanism comprises an elastically deformable material (e.g., the upper ring portion 14' is formed from an elastically deformable polymeric material or plastic) so that the upper ring portion 14' is capable of being elastically deformed when the portion of the object (e.g., the portion of the towel rod 98 in FIGS. 21 and 22) is being inserted into the interior of the upper ring portion 14'.

Figure 12:
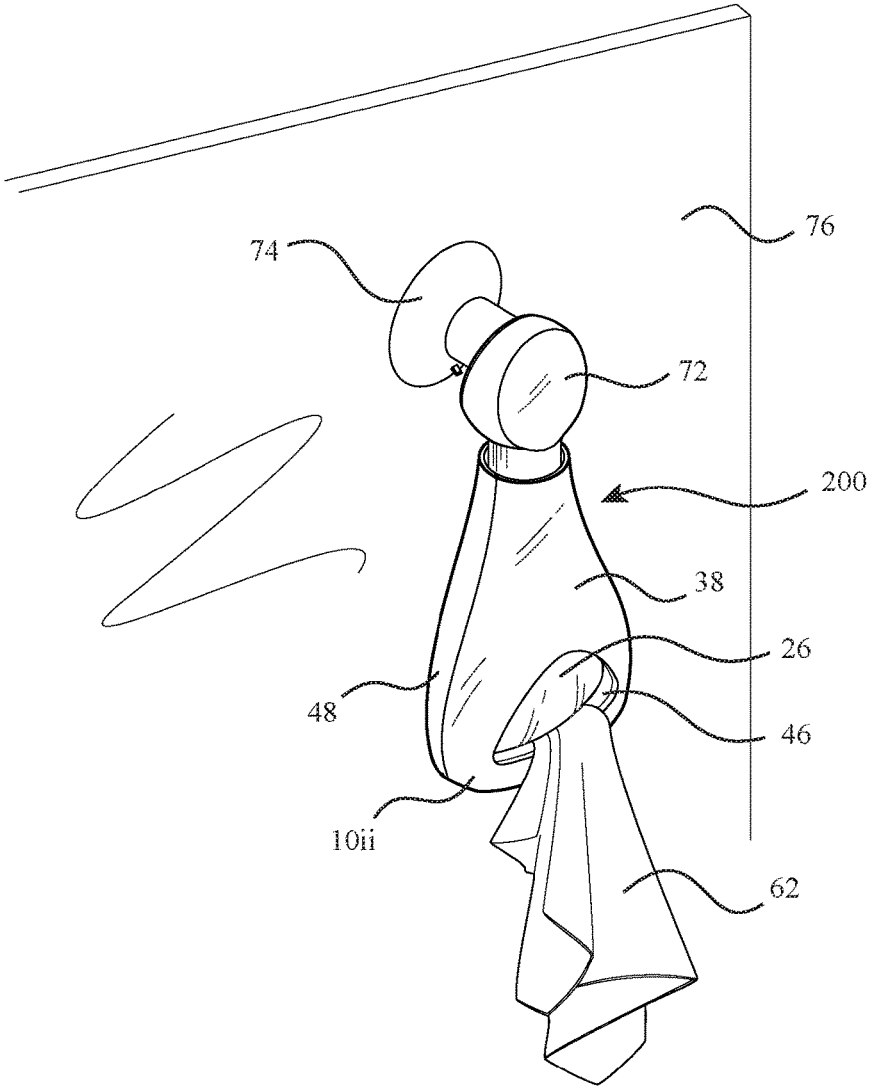
FIG. 12 is a perspective view of another towel holding system comprising a towel holding device, according to another embodiment of the invention, wherein a suction cup attachment apparatus is used to attach the towel holding device to a surface.

Another alternative illustrative embodiment of the attachment mechanism of the towel holding device 10*ii* will be described with reference to the towel holding system 200 depicted in FIG. 12. As shown in this figure, the alternative attachment mechanism comprises a cylindrical attachment member 72 that is connected to a suction cup base portion 74. The suction cup base portion 74 allows the towel holding device 10*ii* to be secured to surfaces of various objects (e.g., to a surface of a mirror 76 in a bathroom—see FIG. 12, or to a front surface of a refrigerator—not explicitly shown herein). As such, the alternative attachment mechanism 72, 74 depicted in FIG. 12 enables the towel holding device 10*ii* to be attached to many additional objects that do not comprise a rod or similar structure, which is required for the ring portions 14, 14' of the aforedescribed attachment mechanisms.

Figure 14:
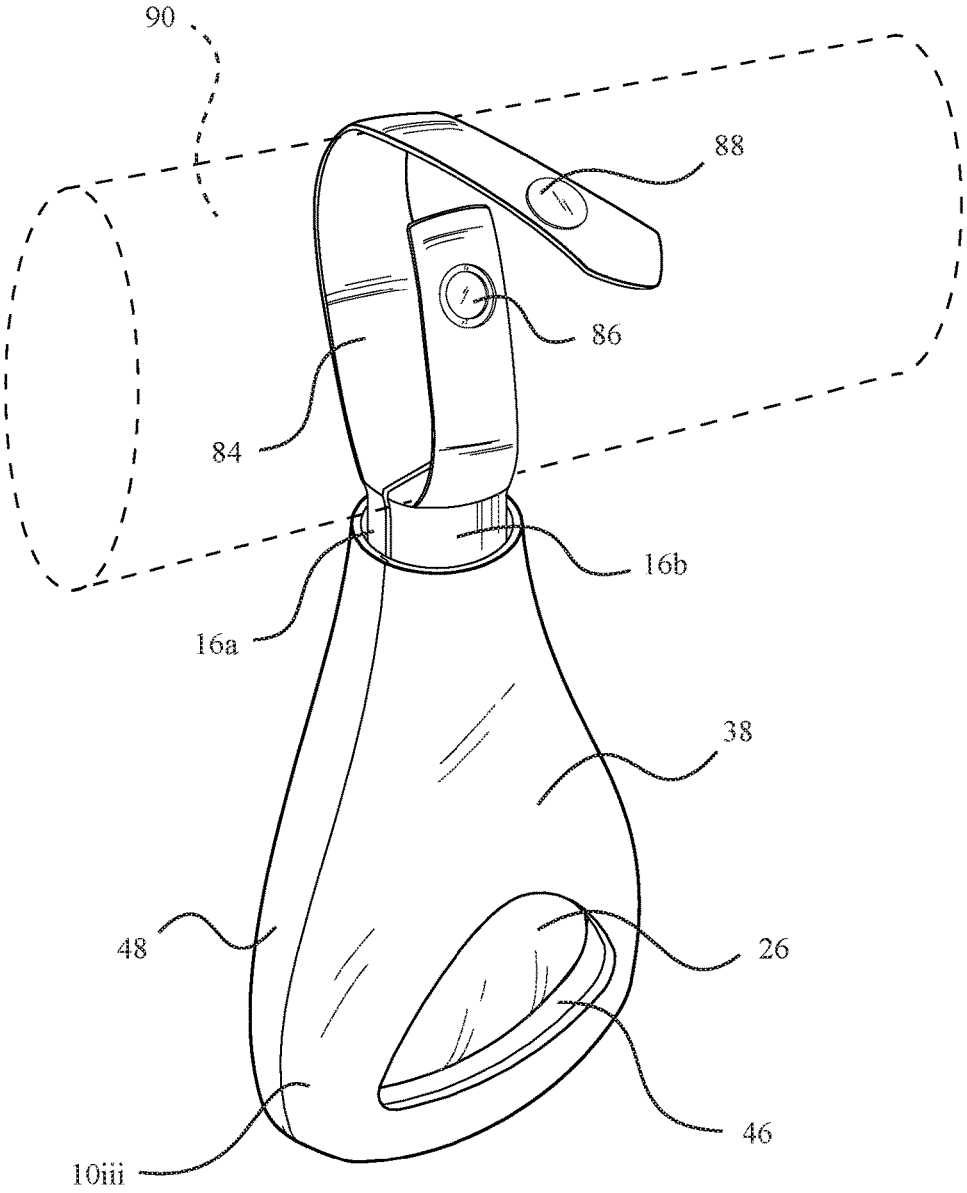
FIG. 14 is a perspective view of another towel holding device, according to another embodiment of the invention, wherein a strap attachment member is used to attach the towel holding device around an oversized object.

Yet another alternative illustrative embodiment of the attachment mechanism of the towel holding device 10*iii* will be described with reference to FIG. 14. As shown in this figure, the alternative attachment mechanism comprises a strap member 84 attached to a cylindrical base portion 16*a*, 16*b*. The strap member 84 of the alternative attachment mechanism is configured to be attached to an object (e.g., an oversized object 90—see FIG. 14, such as a refrigerator handle), and the cylindrical base portion 16*a*, 16*b* of the alternative attachment mechanism is configured to be attached to the tongue member 26 in the same manner described above with regard to the preceding embodiment (i.e., the cylindrical base portion 16*a*, 16*b* of the alternative attachment mechanism contains the same connecting projection 21, 22 of the embodiment in FIGS. 1, 7, and 8). As shown in FIG. 14, at least one portion of the strap member 84 of the alternative attachment mechanism is separable from another portion of the strap member 84 such that an interior of the strap member 84 is capable of being accessed, thereby permitting the attachment mechanism to be wrapped around a portion of the object (e.g., a portion of the oversized object 90 in FIG. 14) and the towel holding device 10*iii* to be secured to the object (i.e., to the oversized object 90 of FIG. 14). With reference again to FIG. 14, it can be seen that the strap member 84 of the alternative attachment mechanism comprises fastener members 86, 88 configured to removably attach the separable end portions of the strap member 84 to one another. More particularly, in the illustrative embodiment, the fastener members 86, 88 of the strap member 84 may comprise first and second snap portions 86, 88 for removably attaching the separable end portions of the strap member 84 to one another (i.e., the ends of the strap member 84 may snap together so as to secure the strap member 84 around the object 90).

Still another alternative illustrative embodiment of the attachment mechanism of the towel holding device 10*vii* will be described with reference to FIGS. 23-35. As shown in these figures, like the alternative attachment mechanism illustrated in FIGS. 21 and 22, the alternative attachment mechanism of FIGS. 23-34 comprises an upper ring portion 14" that is capable of being opened at the top thereof so that the towel holding device 10*vii* can be secured to an object (e.g., a towel rod 98). That is, as illustrated in FIGS. 23-26 and 28-33, at least one portion of the upper ring portion 14" of the alternative attachment mechanism is separable from another portion of the upper ring portion 14" such that an interior of the upper ring portion 14" is capable of being accessed, thereby permitting the attachment mechanism to be wrapped around a portion of an object (e.g., a portion of the towel rod 98, as shown in FIGS. 21 and 22) and the towel holding device 10*vii* to be secured to the object (i.e., to the towel rod 98). As best shown in FIGS. 23, 24, 26, and 28, it can be seen that the separable sections of the upper ring portion 14" are spaced apart by a gap 15 (i.e., the gap 15 separates the sections of the upper ring portion 14" from one another). When the sections of the upper ring portion 14" are separated from one another by a user, an increased gap between the ring sections is formed so that the attachment ring can be wrapped around the portion of the object (e.g., the portion of the towel rod 98). With reference to FIGS. 30-33, it can be seen that the upper ring portion 14" of the alternative attachment mechanism comprises an inner support structure 23 that is formed from a semi-rigid polymeric material or plastic that is capable of being elastically deformed when the separable sections of the upper ring portion 14" are pulled apart by a user of the towel holding device 10*vii*. Turning to FIGS. 23-26, 28, 29, and 35, it can be seen that the upper ring portion 14" of the alternative attachment mechanism further comprises an outer cover 17 that is disposed over, and covers the inner support structure 23. In the illustrative embodiment, the outer cover 17 of the upper ring portion 14" of the towel holding device 10*vii* is formed from a softer polymeric material or plastic than the inner support structure 23 (e.g., the outer cover 17 may be formed from silicone). Unlike the towel holding device 10 described above, the outer cover 17 and the inner support structure 23 of the upper ring portion 14" of the towel holding device 10*vii* of FIGS. 23-34 is permanently attached to the upper cylindrical portion 28 of the tongue member 26, rather than being detachably attached thereto.

In the illustrative embodiment, the attachment mechanism (i.e., an attachment ring 12) of the towel holding device 10 is configured to rotate relative to the towel holding member 26 and the housing portion 38, 48. Preferably, in the illustrative embodiment, the attachment ring 12 of the towel holding device 10 may be configured to rotate at least 180 degrees relative to the towel holding member 26 and the housing portion 38, 48 so that the towel 62 may be easily positioned on the towel holding device 10 (e.g., when the attachment ring 12 is disposed around an object oriented at an angle relative to the towel apertures 46, 56 of the towel holding device 10). More preferably, in the illustrative embodiment, the attachment ring 12 of the towel holding device 10 may be configured to rotate 360 degrees relative to the towel holding member 26 and the housing portion 38, 48 so that the towel apertures 46, 56 of the towel holding device 10 may be disposed at any angled orientation.

Similar to that described above for the upper ring portions 14, 14', in the illustrative embodiment, the polymeric materials forming the outer cover 17 and the inner support structure 23 of the upper ring portion 14" of the alternative attachment mechanism of FIGS. 23-35 are elastically deformable (i.e., both the outer cover 17 and the inner support structure 23 are elastically deformable) so that the upper ring portion 14" is capable of being elastically deformed when the portion of the object (e.g., the portion of the towel rod 98, as shown FIGS. 21 and 22) is being inserted into the interior of the upper ring portion 14".

Figure 37:
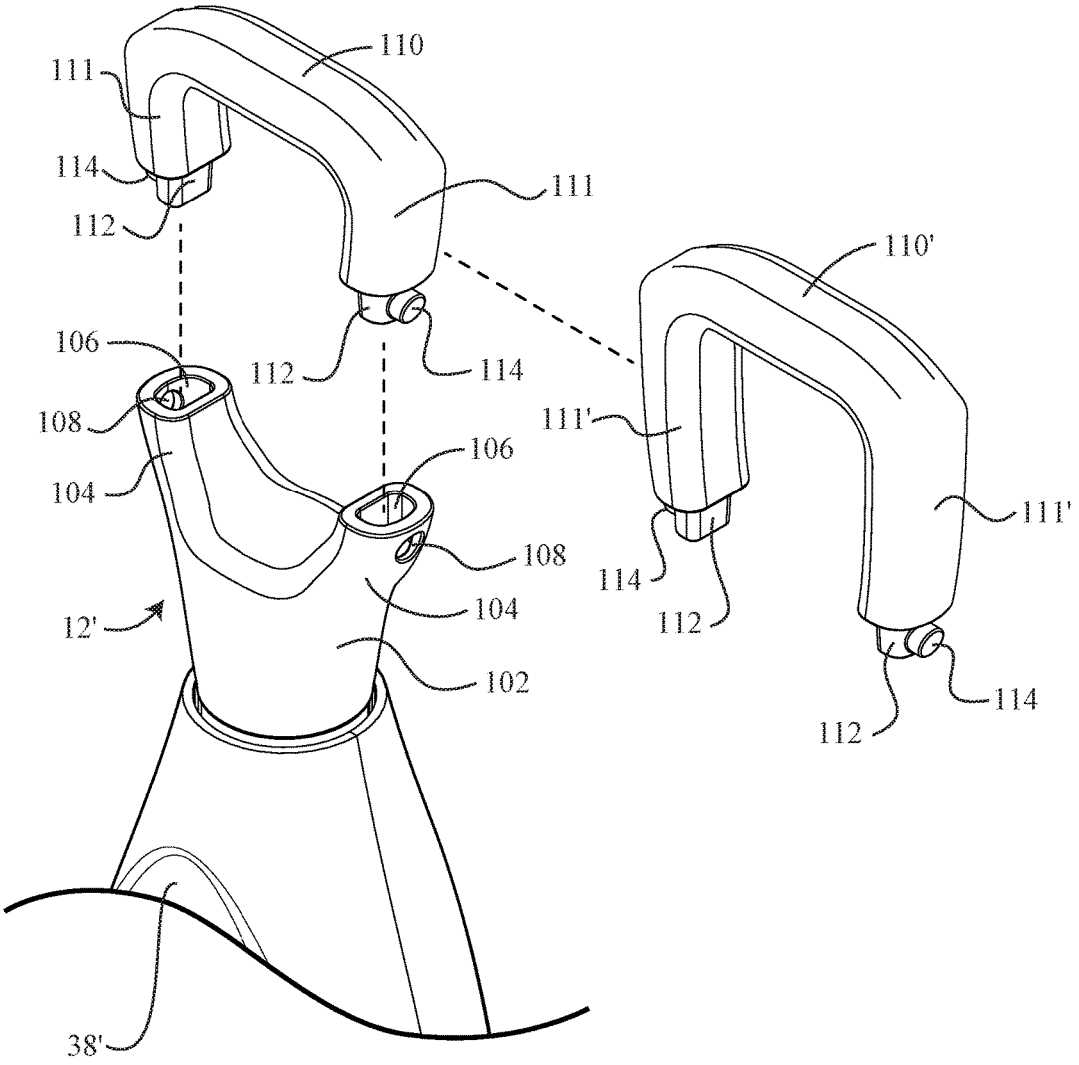
FIG. 37 is a partially exploded perspective view of the attachment ring of FIG. 36 disposed on a towel holding device with an alternative upper loop portion of the attachment ring disposed next to the attachment ring of FIG. 36.

Yet another alternative illustrative embodiment of the attachment mechanism of the towel holding device will be described with reference to FIGS. 36-40. Initially, referring to FIGS. 36 and 37, it can be seen that the alternative attachment mechanism (e.g., the attachment ring 12') is capable of being opened so that the towel holding device can be secured to an object (e.g., a refrigerator handle 118—see FIG. 40). That is, as best illustrated in FIG. 37, the upper loop portion 110 of the alternative attachment mechanism is separable from the lower base portion 102 of the attachment mechanism 12' such that an interior of the attachment mechanism 12' is capable of being accessed, thereby permitting the attachment mechanism 12' to be attached to an object (e.g., a portion of the refrigerator handle 118 shown in FIG. 40) and the towel holding device to be secured to the object (i.e., to the refrigerator handle 118). With combined reference to FIGS. 36 and 37, it can be seen that the upper loop portion 110 of the alternative attachment mechanism comprises a pair of oppositely disposed, downwardly extending arms 111 that are connected to the top of the loop portion. As shown in FIG. 37, a respective downwardly extending protrusion 112 is provided on each of the downwardly extending arms 111. In the illustrative embodiment, each of the downwardly extending protrusions 112 comprises a release device in the form of a button 114 protruding from a respective outer side thereof. Referring again to FIGS. 36 and 37, it can be seen that the lower base portion 102 of the alternative attachment mechanism comprises a pair of oppositely disposed, upwardly extending arms 104 that are configured to engage the downwardly extending arms 111 of the upper loop portion 110. As shown in FIG. 37, each of the upwardly extending arms 104 of the lower base portion 102 is provided with a central recess 106 formed therein for receiving a respective one of the downwardly extending protrusions 112 of the downwardly extending arms 111. In addition, as illustrated in FIG. 37, a respective button aperture 108 is provided in an outer side of each of the upwardly extending arms 104 for receiving a respective one of the buttons 114 of the downwardly extending arms 111 therein. When a user engages the upper loop portion 110 of the attachment mechanism with the lower base portion 102, the buttons 114 of the downwardly extending arms 111 of the upper loop portion 110 snap into their respective button apertures 108 in the upwardly extending arms 104 of the lower base portion 102 so that the upper loop portion 110 becomes detachably coupled to the lower base portion 102. In order to disengage the upper loop portion 110 of the attachment mechanism from the lower base portion 102, a user applies a compressive force against the face of each of the buttons 114 so that the buttons 114 are inwardly displaced, and the upwardly extending arms 104 of the lower base portion 102 are sufficiently deformed so as to enable the upper loop portion 110 to be separated from the lower base portion 102 of the attachment mechanism. After depressing each of the buttons 114, the user then lifts up on the upper loop portion 110 to remove it from the lower base portion 102. Alternatively, rather than pressing both buttons 114, a user may apply a compressive force against the face of one of the buttons 114, and then rotate the upper loop portion 110 about an angle of 30 to 45 degrees until the upper loop portion 110 clears the attachment site (e.g., the towel bar 78), thereby allowing the towel holding device to be removed from the attachment site.

Figure 38:
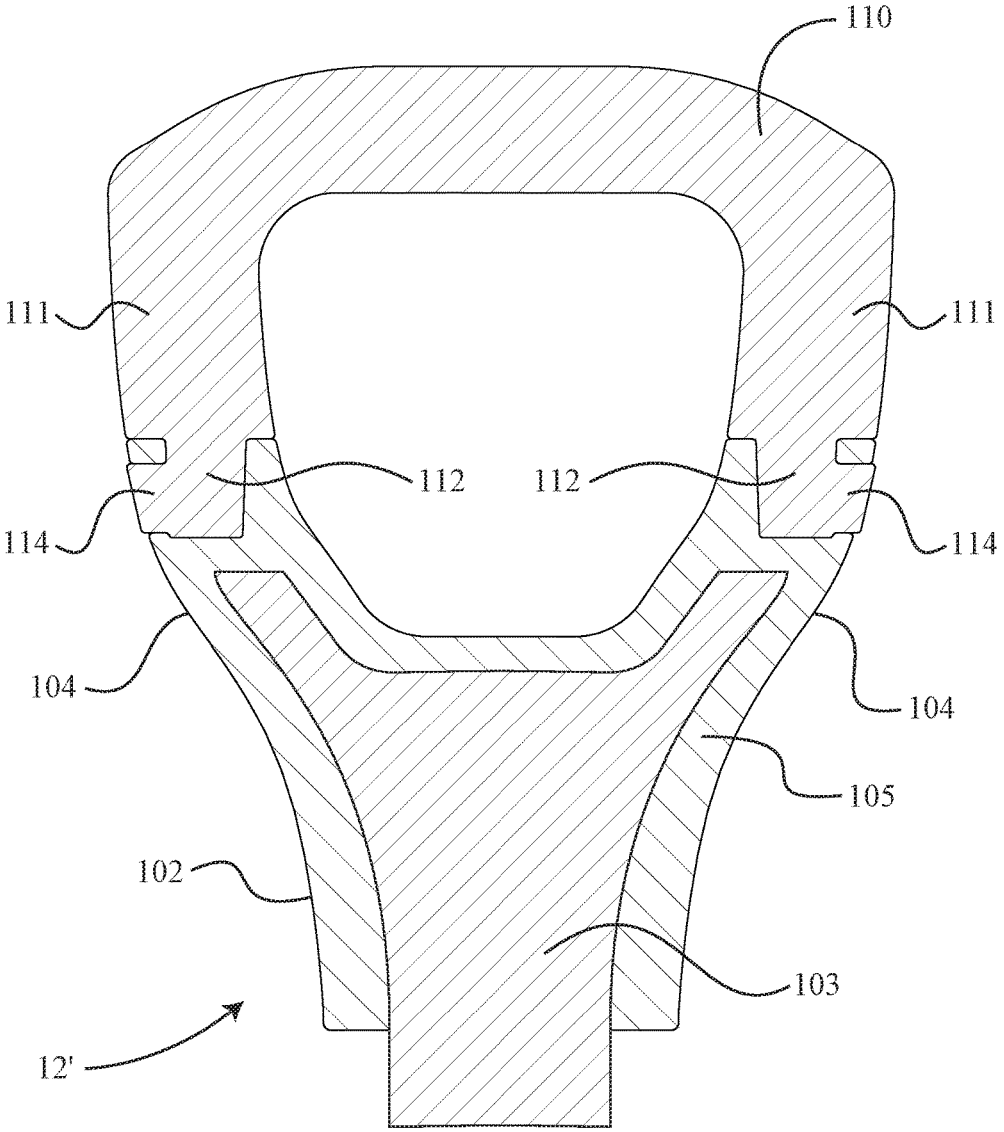
FIG. 38 is a longitudinal sectional view of the attachment ring of FIG. 36, wherein the sectional view is generally cut along the cutting-plane line B-B in FIG. 36.
Figure 39:
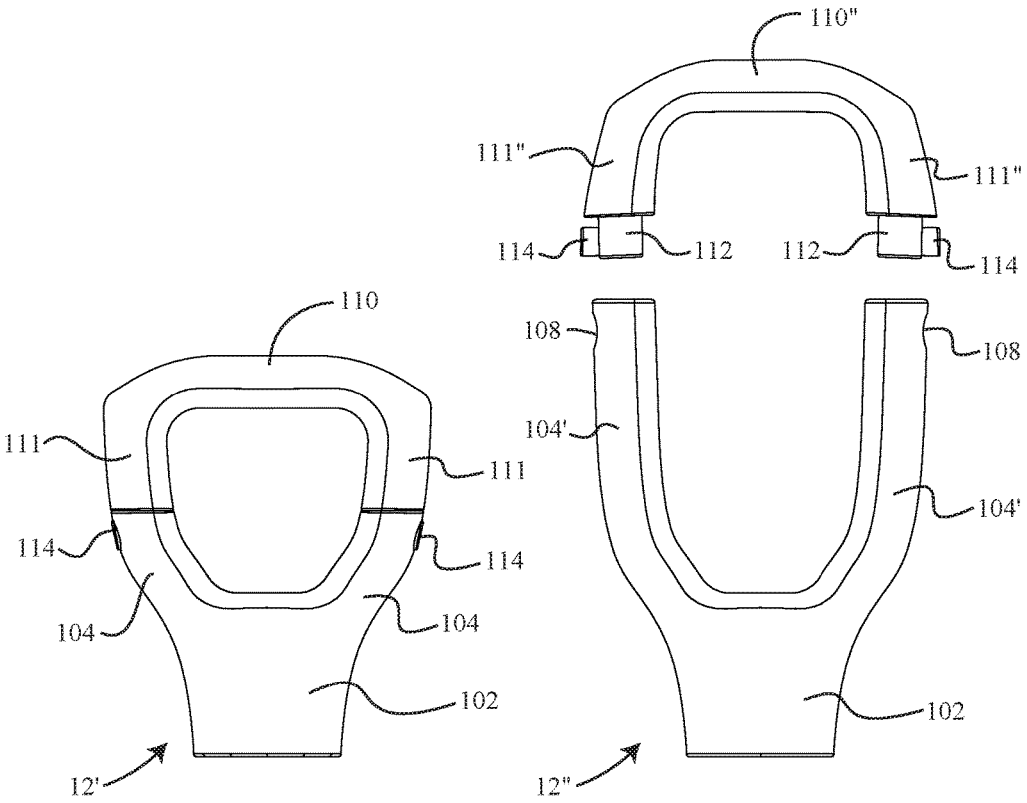
FIG. 39 is a front elevational view of two different sizes of the alternative attachment ring, wherein the attachment ring of FIG. 36 is disposed on the left side of the figure, and an attachment ring with extended lower arm portions is disposed on the right side of the figure.

With reference to the sectional view of FIG. 38, in the illustrative embodiment, the upper loop portion 110 of the attachment mechanism (e.g., attachment ring 12') may be formed from an elastically deformable polymeric material (i.e., an elastically deformable plastic) so that the downwardly extending arms 111 are able to flex when a user applies a compressive force to each of the buttons 114. Also, referring again to the illustrative embodiment of FIG. 38, the lower base portion 102 of the attachment mechanism (e.g., attachment ring 12') may be provided with an outer cover 105 that is formed from a softer polymeric material or plastic than an inner support structure 103 of the lower base portion 102 (e.g., the outer cover 105 may be formed from silicone, while the inner support structure 103 may be formed from a harder plastic) so that, when the buttons 114 are pressed by the user to separate the portions of the attachment mechanism, the soft outer cover 105 of the lower base portion 102 sufficiently deforms so as to permit the buttons 114 to become disengaged from the button apertures 108. Like the attachment mechanism described above with regard to FIGS. 23-35, the lower base portion 102 of the attachment mechanism (e.g., attachment ring 12') is permanently attached to the upper cylindrical portion 28 of the tongue member 26, rather than being detachably attached thereto.

Figure 40:
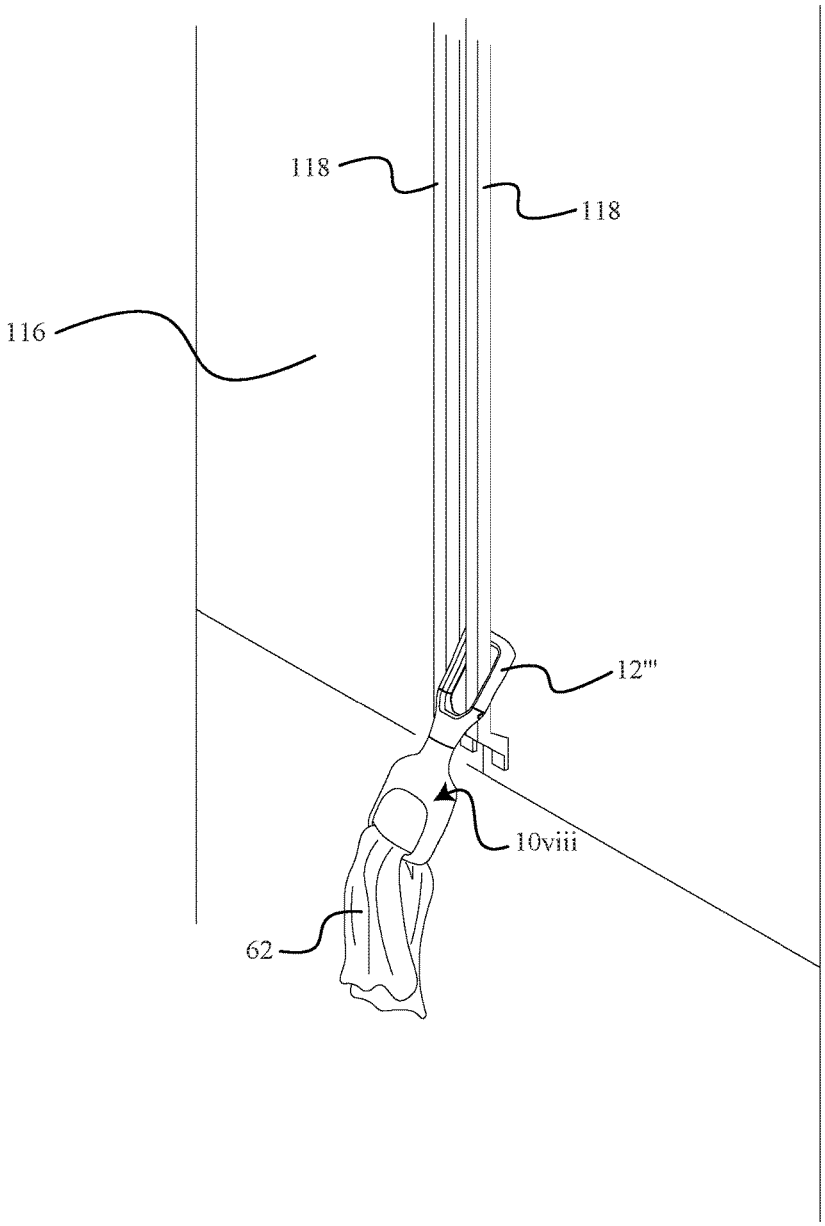
FIG. 40 is a perspective view of a towel holding device with the alternative attachment ring shown being attached to a refrigerator handle.

In the illustrated embodiment, the upper loop portion 110 of the attachment mechanism (e.g., attachment ring 12') of the towel holding device forms a breakaway connection with the lower base portion 102 so that, if a force exceeding a predetermined amount is applied to the towel 62, the buttons 114 of the upper loop portion 110 are configured to be released from the button apertures 108, thereby resulting in the upper loop portion 110 becoming disengaged from the lower base portion 102 without damage being sustained to the towel holding device or the object to which the towel holding device is mounted (e.g., a refrigerator handle 118—see FIG. 40). Because the buttons 114 are received within the button apertures 108 of the outer cover 105 of the lower base portion 102, the breakaway threshold force of the towel holding device is determined by the material properties of the outer cover 105 of the lower base portion 102 and the upper loop portion 110.

In the illustrative embodiment, with reference to FIG. 37, the attachment mechanism (i.e., the attachment ring 12') of the towel holding device is configured to rotate relative to the towel holding member 26 and the housing portion 38', 48'. Preferably, in the illustrative embodiment, the attachment ring 12' of the towel holding device may be configured to rotate at least 180 degrees relative to the towel holding member 26 and the housing portion 38', 48' so that the towel 62 may be easily positioned on the towel holding device (e.g., when the attachment ring 12' is disposed around an object oriented at an angle relative to the towel apertures 46, 56 of the towel holding device). More preferably, in the illustrative embodiment, the attachment ring 12' of the towel holding device may be configured to rotate 360 degrees relative to the towel holding member 26 and the housing portion 38', 48' so that the towel apertures 46, 56 of the towel holding device may be disposed at any angled orientation.

In order to accommodate mounting the towel holding device on objects of various sizes, different configurations of the upper loop portion 110 of the attachment mechanism (i.e., the attachment ring 12') may be used. For example, as shown on the right side in FIG. 37, the upper loop portion 110' may be provided with downwardly extending arms 111' having a longer length as compared to those in FIG. 36 so that the towel holding device may be mounted to larger objects, such as the refrigerator handle 118 in FIG. 40. As another example, with reference to FIG. 39, it can be seen that the lower base portion 102 of the attachment mechanism (i.e., the attachment ring 12") on the right side of this figure may be provided with elongated arms 104' so as to accommodate oversized objects on which the towel holding device may be mounted. The elongated arms 104' are configured to matingly engage with the downwardly extending arms 111" of the upper loop portion 110" depicted on the right side of FIG. 39. In one or more embodiments, the attachment mechanism of the towel holding device is provided with a plurality of interchangeable upper loop portions 110, 110', 110" of different sizes so as to enable the towel holding device to be attached to different objects having various sizes. As such, the upper loop portions 110, 110', 110" may be interchangeably swapped out when it is necessary to accommodate objects having various sizes.

Figure 11:
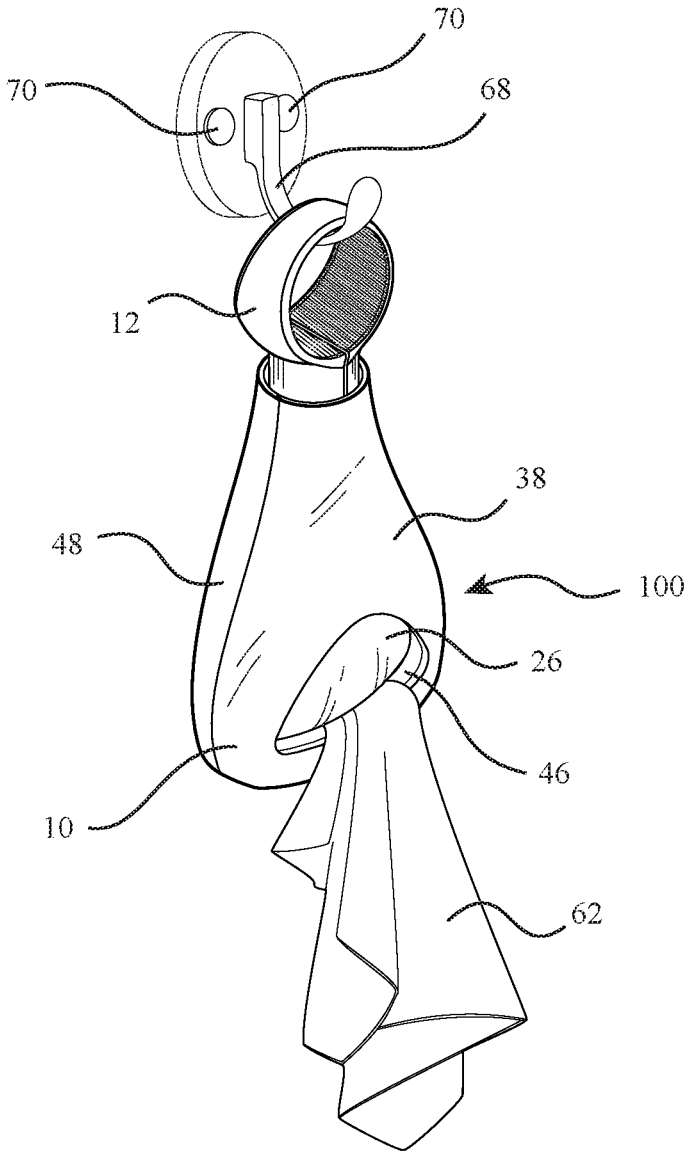
FIG. 11 is another perspective view of the towel holding system of FIG. 9, wherein the towel holding device is attached to a towel hook.
Figure 13:
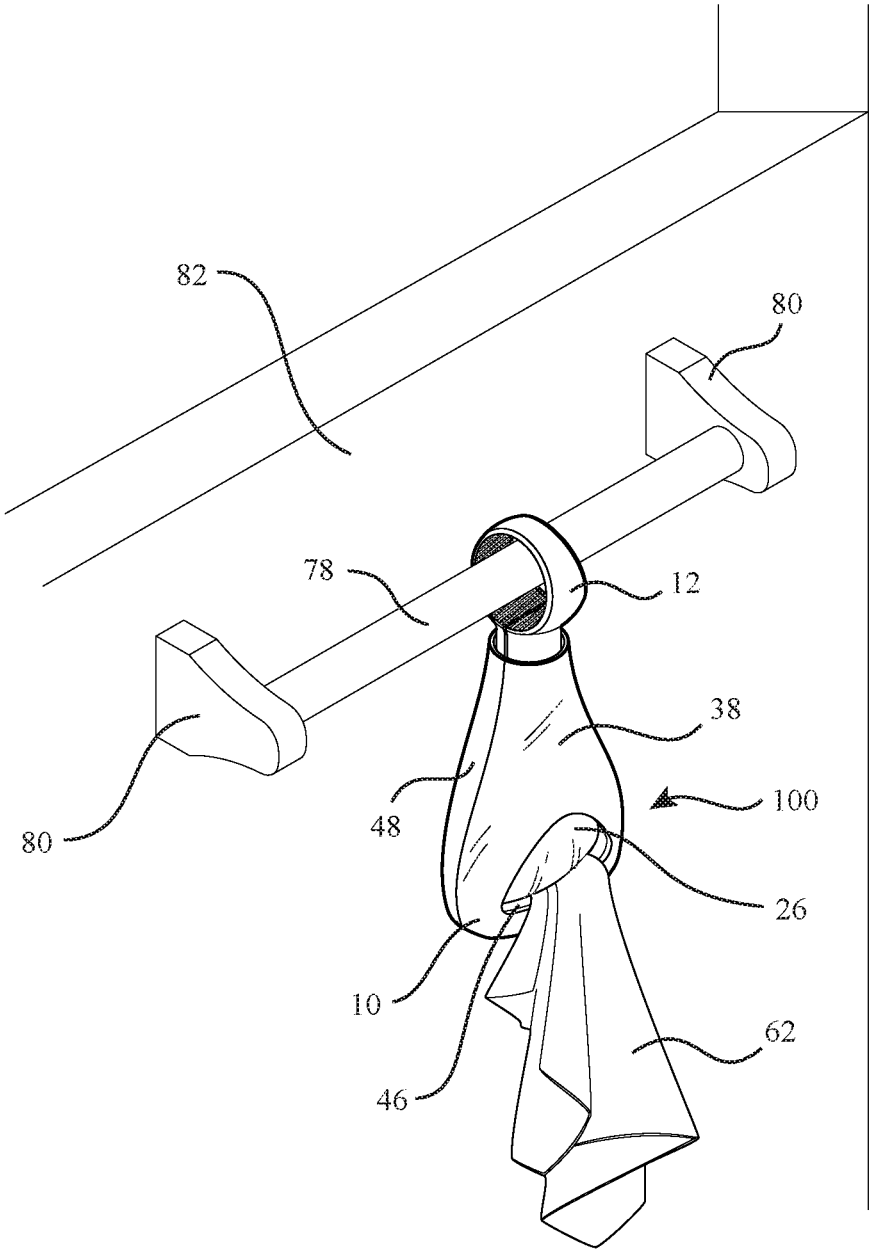
FIG. 13 is another perspective view of the towel holding system of FIG. 9, wherein the towel holding device is attached to a towel rod.

As illustrated above, the towel holding device described herein is capable of being attached to a myriad of different objects. As some examples, the towel holding device may be attached to: (i) a towel rod 78, 98 (see FIGS. 13, 21, and 22), (ii) an oversized object 90 (see FIG. 14), such as a refrigerator handle, (iii) a cabinet handle, (iv) a cabinet knob, (v) a surface of a mirror 76 (see FIG. 12) or any other surface on which the suction cup base 74 is capable of being attached, (vi) a towel hook 68 (see FIG. 11), (vii) an oven door, (viii) a microwave handle, and (ix) a door knob. In FIG. 11, the towel holding device 10 is shown hanging from the towel hook 68. The towel hook 68 of FIG. 11 comprises a disk-like base portion that is secured to a mounting surface (e.g., a wall surface) by means of a pair of spaced-apart fasteners 70 (e.g., a pair of screws). In FIG. 13, the towel holding device 10 is shown hanging from the towel rod 78. The towel rod 78 of FIG. 13 is secured to a wall 82 by means of a pair of spaced-apart mounting brackets 80. Other exemplary mounting arrangements for towel holding device were described with regard to FIGS. 12, 14, 21, and 22. In FIG. 40, the towel holding device 10*viii* with the elongated attachment mechanism 12''' is shown hanging from the refrigerator handle 118 of a refrigerator 116 so as to support the hanging towel 62 therefrom.

Next, referring primarily to FIGS. 1, 7, and 9, the towel holding member (e.g., tongue member 26) of the towel holding device 10 will be explained. While the tongue member 26 and the other components described hereinafter will be described with reference to towel holding device 10, it is to be understood that the description of these components are equally applicable to towel holding devices 10*i*, 10*ii*, 10*iii*, 10*iv*, 10*v*, 10*vi*, 10*vii*, 10*viii*, 10*ix* as well, unless expressly stated otherwise herein. As particularly shown in the exploded view of FIG. 7, the tongue member 26 includes an upper cylindrical portion 28 configured to be attached to the attachment mechanism (i.e., as described above, the connecting projection 21, 22 of the cylindrical base portion 16*a*, 16*b* of the attachment ring 12 engages with the aperture 32 and the cavity 33 of the upper cylindrical portion 28), and the tongue member 26 also includes a lower base portion 30 configured to engage the towel 62 (e.g., see FIG. 9) when the towel 62 is being held in the towel holding device 10. In FIG. 7, it can be seen that the lower base portion 30 of the tongue member 26 is flared outwardly relative to the upper cylindrical portion 28 of the tongue member 26.

Figure 19:
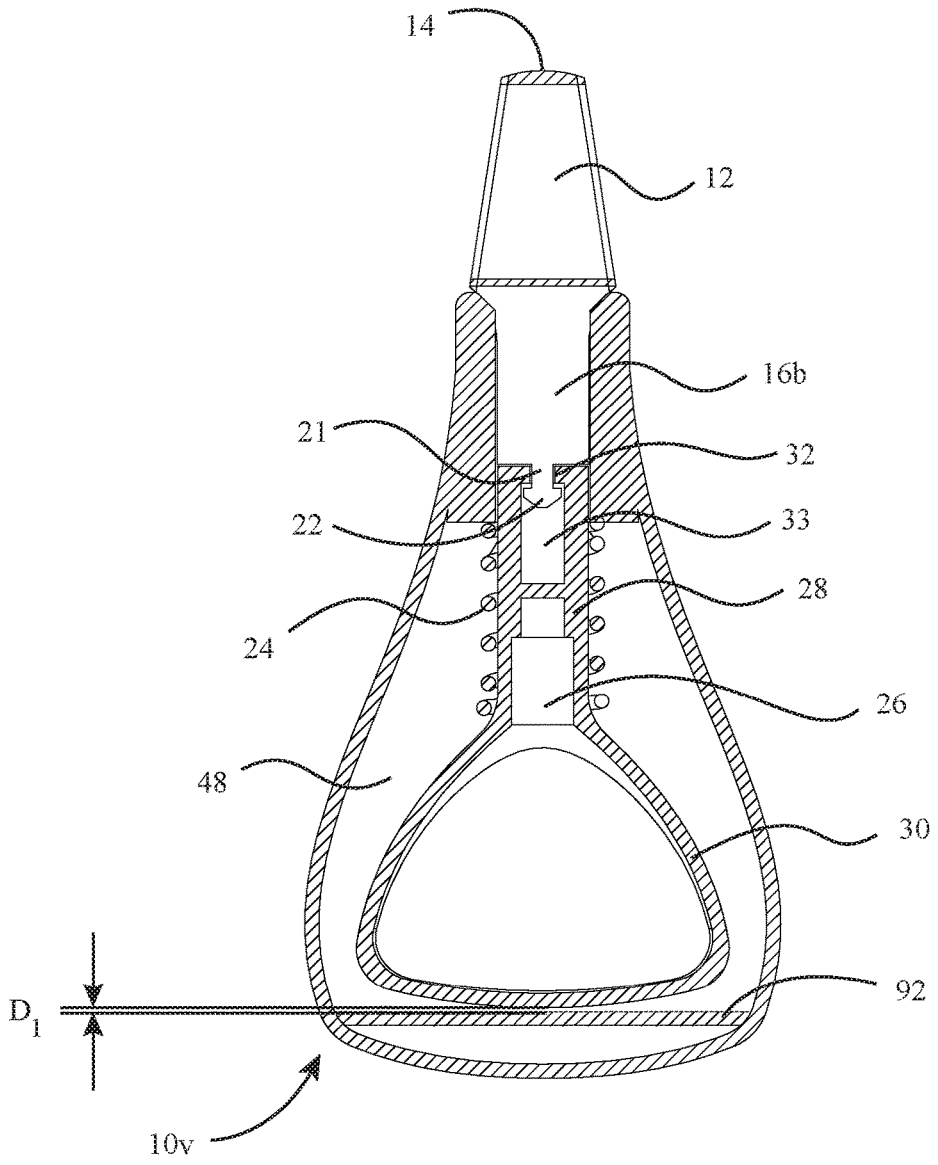
FIG. 19 is a longitudinal sectional view of yet another towel holding device, according to yet another embodiment of the invention, wherein the towel holding device of FIG. 19 is similar in most respects to the towel holding device of FIG. 1 except that the towel holding device is provided with an elevated floor member, the tongue member of the towel holding device in FIG. 19 is disposed in its resting position.
Figure 20:
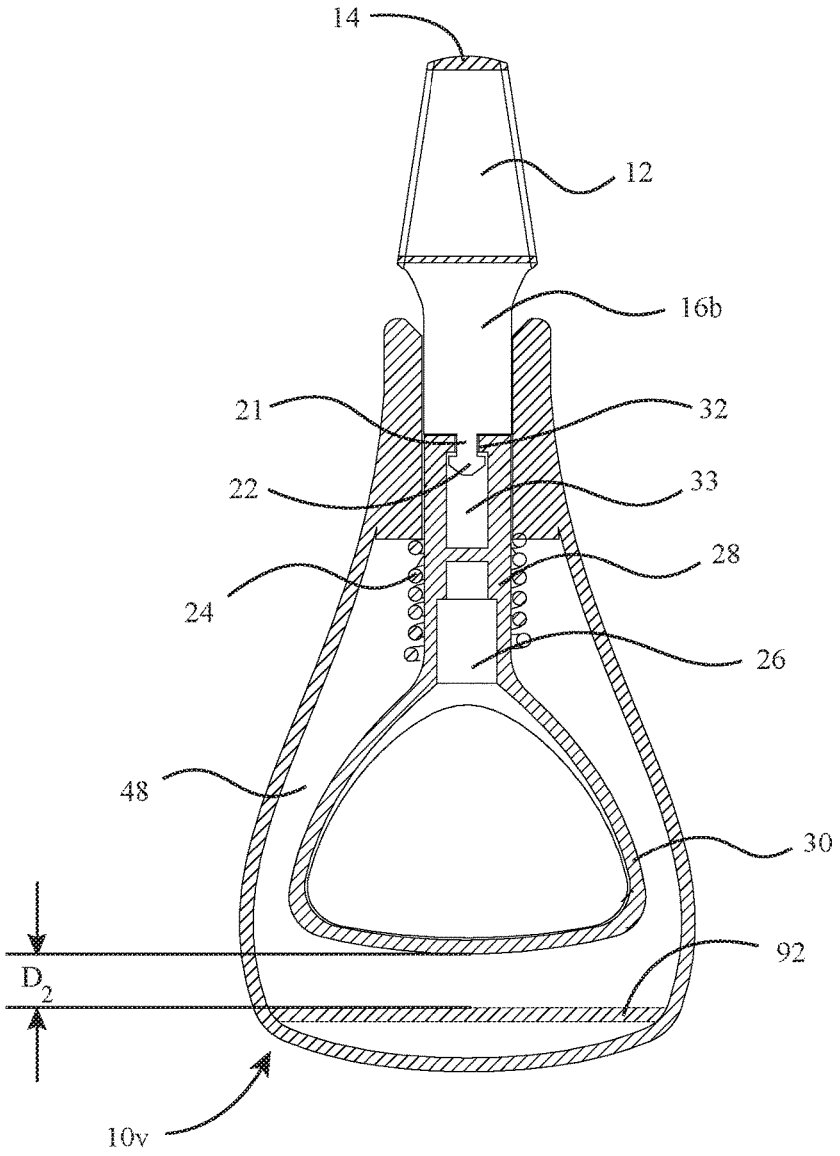
FIG. 20 is another longitudinal sectional view of the towel holding device of FIG. 19, wherein the tongue member of the towel holding device in FIG. 20 is disposed in its displaced position.

As shown in FIGS. 7, 19, and 20, the towel holding device 10 further comprises a cylindrical spring member 24 configured to bias the tongue member 26 in an engaged position with the towel 62 (see FIGS. 9, 11-13, and 18) so as to securely hold the towel 62 in place within the towel holding device 10. With particular reference to FIGS. 19 and 20, it can be seen that the spring member 24 is disposed around the upper cylindrical portion 28 of the tongue member 26 in the assembled state of the towel holding device 10. Referring to the exploded view of FIG. 7, the lower end of the spring member 24 is configured to rest on the top of a pair of spaced-apart spring support tabs 34, 36 on the tongue member 26, while the upper end of the spring member 24 is configured to be disposed against an abutment 51 in the upper collar portion 40, 50 of the housing portion 38, 48. As such, the spring member 24 is supported between the spring support tabs 34, 36 and the abutment 51, and applies a upwardly-directed spring force on the housing portion 38, 48 so as to bias the housing portion floor towards the bottom of the tongue member 26. When a downward force is applied to the housing portion 38, 48 by a hand 64 of a user (as diagrammatically indicated by the downwardly-directed arrow 66 in FIG. 10), the spring member 24 is configured to be compressed, and the housing portion 38, 48 is configured to be displaced relative to the attachment ring 12 and the towel holding member 26. In an alternative embodiment, rather than providing the spring member 24, a spring-like mechanism that operates in a similar manner to a spring may be provided (i.e., a mechanism that is capable of elastically flexing up and down when a force is applied thereto).

In the illustrated embodiment, the towel holding member 26 of the towel holding device 10 forms a breakaway connection with the towel 62 so that, if a force exceeding a predetermined amount is applied to the towel 62, the towel 62 is configured to be released from the towel holding member 26 without damage being sustained to the towel holding device 10, the object to which the towel holding device 10 is mounted (e.g., a towel rod 98), or the attachment surface on which the object in mounted (e.g., the wall 82 in FIG. 13). Because the spring member 24 holds the tongue member 26 in engagement with the towel 62, the breakaway threshold force of the towel holding device 10 is determined by the stiffness and the strength of the spring member 24 (i.e., the spring constant of the spring member 24).

Now, with reference to FIGS. 1-7, the structure of the housing portion 38, 48 of the towel holding device 10 will be described. As best shown in the perspective view of FIG. 1 and the exploded view of FIG. 7, the housing portion 38, 48 of the towel holding device 10 comprises a front housing portion 38 and a rear housing portion 48. Together the front and rear housing portions 38, 48 form a hollow enclosure for containing the tongue member 26 of the towel holding device 10 therein. In the assembled state of the towel holding device 10 illustrated in FIG. 1, it can be seen that the towel holding device 10 comprises a longitudinal seam 60 at the location where the front housing portion 38 is adjoined to the rear housing portion 48. Referring again to FIG. 7, it can be seen that the front housing portion 38 comprises an upper collar portion 40 and a lower base portion 42. Similarly, the rear housing portion 48 comprises an upper collar portion 50 and a lower base portion 52. As shown in the figures, similar to the tongue member 26 described above, the lower base portions 42, 52 of the front and rear housing portions 38, 48 are flared outwardly relative to the upper collar portions 40, 50. In the illustrated embodiment, referring to FIG. 7, the front housing portion 38 comprises a towel aperture 46 for receiving the towel 62 therein, and similarly, the rear housing portion 48 also comprises a towel aperture 56 for receiving the towel 62 therein. The towel apertures 46, 56 in the respective lower base portions 42, 52 of the front and rear housing portions 38, 48 allow a passage of a towel 62 through oppositely disposed sides of the towel holding device 10 (as shown in towel holding system 300 of FIG. 18). Turning again to FIG. 7, it can be seen that the upper collar portions 40, 50 of the front and rear housing portions 38, 48 comprise respective attachment ring passageways 44, 54 for receiving the cylindrical base portion 16*a*, 16*b* of the attachment ring 12 therein. Also, the upper collar portions 40, 50 of the front and rear housing portions 38, 48 comprise an abutment 51 to limit the movement of the front and rear housing portions 38, 48 relative to the towel holding device 10 (see FIG. 7). That is, the spring member 24 is compressed against the abutment 51, thereby limiting the vertical downward distance that the housing portion 38, 48 of the towel holding device 10 is able to travel. Also, in the illustrative embodiment, the front and rear housing portions 38, 48 may comprise a plurality of spaced-apart ribs 58 for increasing a structural rigidity of the front and rear housing portions 38, 48. For example, as shown in FIG. 7, the plurality of reinforcing ribs 58 may be disposed in the lower base portions 42, 52 of the front and rear housing portions 38, 48 beneath the towel apertures 46, 56. In the illustrative embodiment, the reinforcing ribs 58 add rigidity to the housing 38, 48 of the towel holding device 10 by connecting the side walls of the front and rear housing portions 38, 48 to the floor portions of the front and rear housing portions 38, 48.

Figure 3:
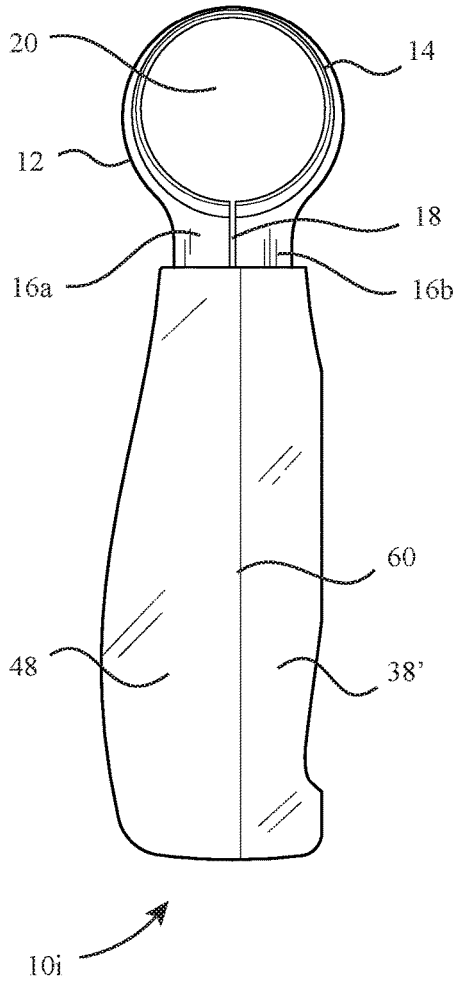
FIG. 3 is a side view of a towel holding device similar to that of FIG. 1, except that the front housing portion is provided with an indentation formed therein.
Figure 4:
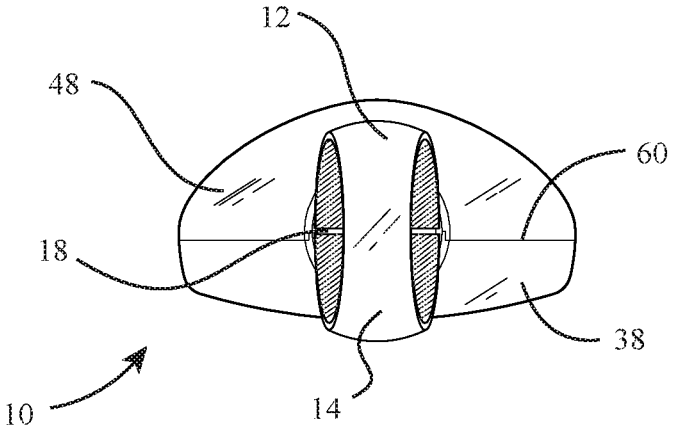
FIG. 4 is a top plan view of the towel holding device of FIG. 1.
Figure 5:
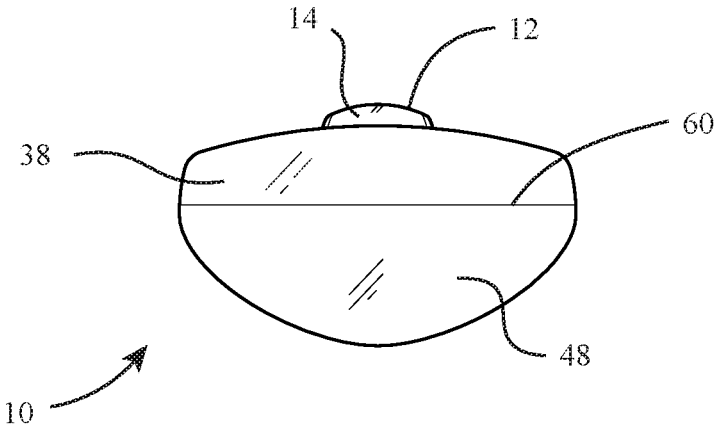
FIG. 5 is a bottom plan view of the towel holding device of FIG. 1.
Figure 6:
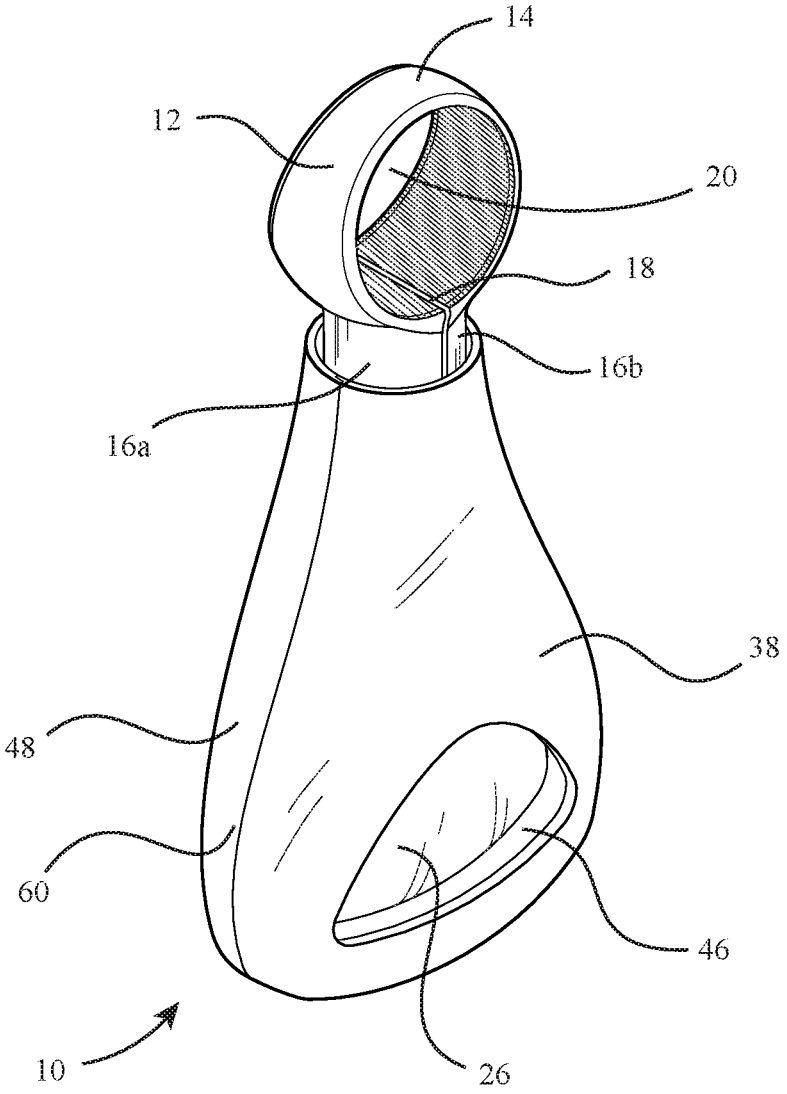
FIG. 6 is another perspective view of the towel holding device of FIG. 1, wherein the attachment ring of the towel holding device is disposed in a second position.

An alternative illustrative embodiment of the housing portion of the towel holding device 10*i* will be described with reference to FIG. 3. As shown in the side view of FIG. 3, the front housing portion 38' of the towel holding device 10*i* has a flatten front side rather than the curved front side of the embodiment of the towel holding device 10 in FIG. 1. In all other respects, the towel holding device 10*i* of FIG. 3 is generally the same as the FIG. 1 embodiment of the towel holding device.

Figure 17:
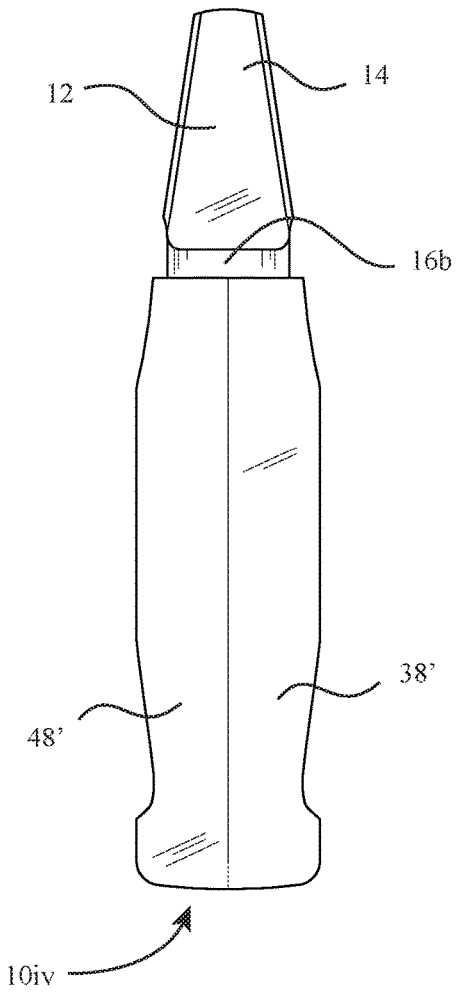
FIG. 17 is a side view of a towel holding device similar to that of FIG. 1, except that the front and rear housing portions are provided with indentations formed therein.

Another alternative illustrative embodiment of the housing portion of the towel holding device 10*iv* will be described with reference to FIG. 17. As shown in the side view of FIG. 17, similar to the embodiment of FIG. 3 described above, the front housing portion 38' of the towel holding device 10*iv* has a flatten front side. Although, unlike the aforedescribed embodiment of FIG. 3, the towel holding device 10*iv* depicted in FIG. 17 also contains a rear housing portion 48' with a flatten rear side rather than a curved side. In the FIG. 17 embodiment, each of the towel apertures 46, 56 is disposed in a respective flatten region of the front and rear housing portions 38', 48'. In all other respects, the towel holding device 10*iv* of FIG. 17 is generally the same as the FIG. 1 and FIG. 3 embodiments of the towel holding device.

Yet another alternative illustrative embodiment of the housing portion of the towel holding device 10*v* will be described with reference to FIGS. 19 and 20. As shown in the longitudinal sectional views of FIGS. 19 and 20, the rear housing portion 48 of the towel holding device 10*v* has an elevated floor member 92 disposed at the bottom thereof. While not explicitly shown in the sectional views of FIGS. 19 and 20, the front housing portion 38 of the towel holding device 10*v* is also provided with an elevated floor member 92 that is aligned with the elevated floor member of the rear housing portion 48. As illustrated in these figures, the elevated floor member 92 (i.e., false floor 92) is spaced-apart from a bottom wall of the housing portion 48, and has a generally flat upper surface. In the highest position of the housing portion 38, 48, the towel holding member 26 may be configured to rest against the upper surface of the elevated floor member 92. Advantageously, when the towel member 62 is inserted into the towel holding device 10*v*, the elevated floor member 92 helps to prevent the towel 62 from catching on the bottom wall of the housing portion 38, 48 or the bottom recess of the housing portion 38, 48 so that the towel 62 is able to be more easily inserted through the towel apertures 46, 56 of the towel holding device 10*v*. Other than having the elevated floor member 92, the towel holding device 10*v* of FIGS. 19 and 20 is generally the same as the preceding embodiments of the towel holding device in all other respects. In an alternative embodiment, rather than providing an elevated floor member 92, the bottom walls of the housing portions 38, 48 may simply be provided with a layer of material having a thickness that is approximately double the thickness of the remainder of the housing so as to form a substantially flat floor (i.e., a floor that is flat except for curved portions around its perimeter where it meets the sidewalls of the housing).

Figure 41:
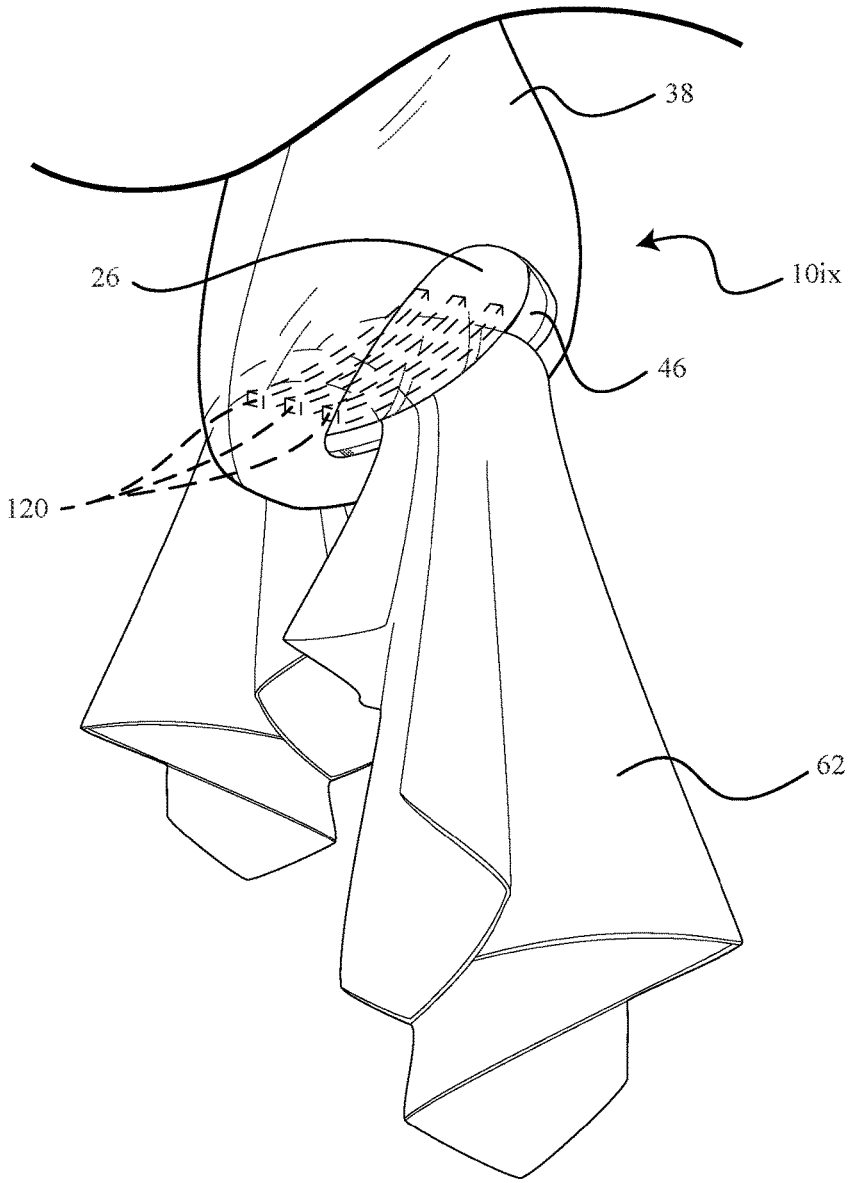
FIG. 41 is a partial perspective view of a towel holding device, according to an alternative embodiment, wherein the towel holding device is provided with towel retaining ribs on the bottom floor of the housing of the towel holding device.

An alternative embodiment of a towel holding device 10*ix* is depicted in FIG. 41. The towel holding device of FIG. 41 is similar in most respects to the towel holding devices described above except that a plurality of towel retaining ribs 120 are provided on the bottom floor of the housing of the towel holding device 10*ix*. In the illustrative embodiment of FIG. 41, the plurality of spaced-apart towel retaining ribs 120 advantageously prevent the towel 62 from becoming inadvertently disengaged from the towel holding device 10*ix*. Specifically, when the tongue member 26 is in its engaged position with the towel 62 (as shown in FIG. 41), the tongue member 26 compresses the towel 62 against the towel retaining ribs 120, thereby retaining the towel 62 in place. As shown in FIG. 41, the plurality of towel retaining ribs 120 may be disposed on the floor of the housing beneath the towel apertures 46, 56.

Figure 10:
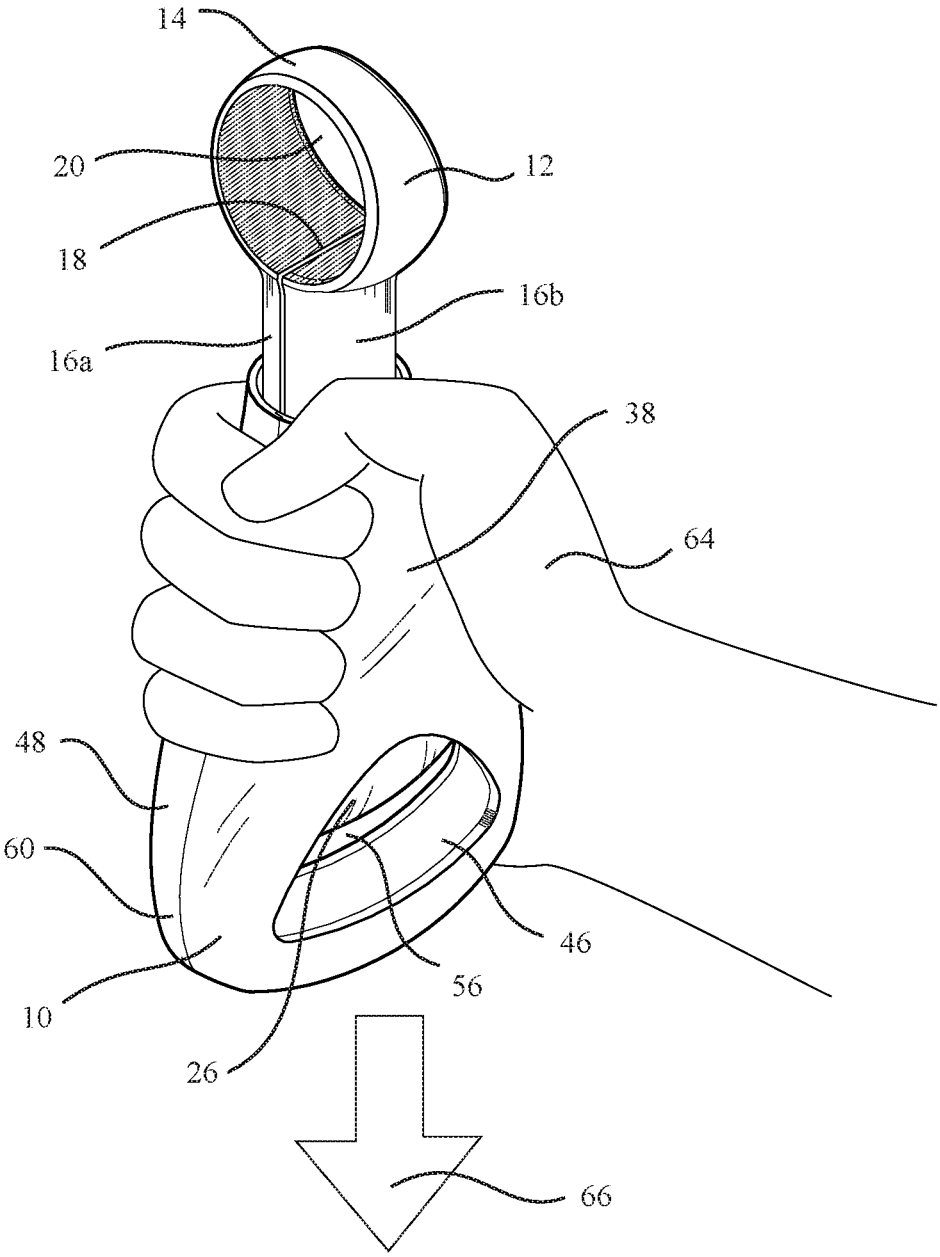
FIG. 10 is yet another perspective view of the towel holding device of FIG. 1, wherein a user is grasping and pulling down on the housing of the towel holding device so that a towel may be inserted therein.

Now, referring primarily to FIGS. 10, 15, 19, and 20, the functionality of the towel holding device will be explained in detail. Initially, as shown in FIG. 10, a user grasps the housing portion 38, 48 of the towel holding device 10 with his or her hand 64 (e.g., his or her right hand 64), and pulls down on the housing portion 38, 48 of the towel holding device 10 (as diagrammatically indicated by the downwardly-directed arrow 66 in FIG. 10). When the user exerts the downward force on the housing portion 38, 48 of the towel holding device 10, the spring member 24 is compressed, and a gap is created between the bottom surface of the tongue member 26 and the top surface of the housing floor. For example, as shown in FIG. 19, when a downward force is not being applied to the housing portion 38, 48 of the towel holding device, the bottom of the tongue member 26 disposed on, or just above the top surface of the housing floor 92 (i.e., the bottom of the tongue member 26 is only separated from the top surface of the housing floor 92 by a very small distance $D_1$). However, as shown in FIG. 20, when a downward force is being applied to the housing portion 38, 48 of the towel holding device by the user, the bottom of the tongue member 26 is spaced apart from the top surface of the housing floor 92 by a considerable gap (i.e., the bottom of the tongue member 26 is separated from the top surface of the housing floor 92 by a much larger distance $D_2$). Next, turning to FIG. 15, it can be seen that, while the user applies a downward force on the housing portion 38, 48 of the towel holding device 10 with his or her first hand 64 (e.g., his or her right hand 64), the user may use his or her other hand 65 (e.g., his or her left hand 65) to insert the towel 62 into the gap between the tongue member 26 and the housing floor. Finally, after inserting the towel 62 into the towel holding device 10, the user releases his or her grasp on the housing portion 38, 48 of the towel holding device 10, and the spring force exerted by the spring member 24 pushes the housing portion 38, 48 upwardly so as to sandwich the towel 62 in between the tongue member 26 and the housing floor, thereby holding the towel 62 in place on the towel holding device 10. In some embodiments, the towel 62 may be inserted through only one side of the housing portion 38, 48 of the towel holding device 10 (e.g., as shown in FIG. 9), while in other embodiments, the towel 62 may be inserted through both sides of the housing portion 38, 48 of the towel holding device 10 (e.g., as shown in FIG. 18).

It is readily apparent that the aforedescribed towel holding device 10*i*, 10*ii*, 10*iii*, 10*iv*, 10*v*, 10*vi*, 10*vii*, 10*viii*, 10*ix* and the towel holding system 100, 200, 300 including the same offers numerous advantages. First, the towel holding device 10*i*, 10*ii*, 10*iii*, 10*iv*, 10*v*, 10*vi*, 10*vii*, 10*viii*, 10*ix* and the towel holding system 100, 200, 300 described herein securely grasps the towel 62 being supported thereby so as to maintain the cleanliness of the towel 62 by preventing the towel from falling onto the floor (e.g., when grabbed by children). Thus, the towel 62 remains clean and available for other users. Advantageously, by using the towel holding device 10*i*, 10*ii*, 10*iii*, 10*iv*, 10*v*, 10*vi*, 10*vii*, 10*viii*, 10*ix* described herein, the towel 62 is capable of remaining on the towel bar and ready for use despite the carelessness and roughness of the users thereof (e.g., even if children swing on the towel 62 or throw the towel, it would still remain attached to the towel bar). As such, parents are able to be reasonably certain that the towel 62 had not been on the floor, and thus is clean enough for use. Secondly, the towel holding device 10*i*, 10*ii*, 10*iii*, 10*iv*, 10*v*, 10*vi*, 10*vii*, 10*viii*, 10*ix* and the towel holding system 100, 200, 300 enables the hanging length of the towel 62 to be readily adjusted so as accommodate the towel height requirements of various users. By adjusting the length of the towel 62 supported on towel holding device 10*i*, 10*ii*, 10*iii*, 10*iv*, 10*v*, 10*vi*, 10*vii*, 10*viii*, 10*ix*, it can be made more accessible to a user of any size (e.g., a small child or an adult). That way, users are able to conveniently reach the towel 62 without jumping and pulling it off the towel bar, or hurting themselves. Thirdly, the towel holding device 10*i*, 10*ii*, 10*iii*, 10*iv*, 10*v*, 10*vi*, 10*vii*, 10*viii*, 10*ix* and the towel holding system 100, 200, 300 is capable of being readily positioned in virtually any location where a user needs to use a towel 62. For example, by using the suction cup attachment mechanism described above in conjunction with FIG. 12, the towel holding device 10*ii* is able to be positioned in a convenient location without necessitating the permanent installation of a towel bar to the wall (e.g., the suction cup base portion 74 could be temporarily adhered to the mirror 76 in a bathroom in a user preferred location—see FIG. 12). As another example, the towel holding device could be used in the kitchen by attaching the device to an object, such as a cabinet knob or refrigerator handle, in a location that is readily accessible to the user of the towel. As yet another example, the towel holding device would enable the towel 62 to be placed in locations that do not have a permanent towel bar, such as a garage, camper, cabin, boat, patio, deck, car, etc. In addition, the towel holding device 10*i*, 10*ii*, 10*iii*, 10*iv*, 10*v*, 10*vi*, 10*vii*, 10*viii*, 10*ix* and the towel holding system 100, 200, 300 facilitates the use of the towel or rag supported thereby. For example, the towel holding device may enable the towel or rag to be readily available to the user without requiring the user to search for the towel or rag. As another example, the towel holding device would make it easier for people with disabilities to use the towel disposed on the device (e.g., shaking or poor hand/eye coordination, etc. would not prevent the use of a towel because the towel holder device would make the towel more accessible and easier to grasp). As yet another example, the towel holding device would make it easier for older adults, who may have certain difficulties using conventional towels on a towel bar, to use the towel supported on the towel holding device. Finally, the towel holding device 10*i*, 10*ii*, 10*iii*, 10*iv*, 10*v*, 10*vi*, 10*vii*, 10*viii*, 10*ix* and the towel holding system 100, 200, 300 helps to prevent damage to the towel bar and/or the wall on which the towel bar is mounted. For example, the breakaway connection described above would enable the towel to be released from the towel holding device before the towel bar and/or the wall sustained any serious damage. Advantageously, the towel holding device 10*i*, 10*ii*, 10*iii*, 10*iv*, 10*v*, 10*vi*, 10*vii*, 10*viii*, 10*ix* described herein is designed for ease of operation so that users of most ages (e.g., ages 5 to 100) are able to easily and effectively operate the towel holding device 10*i*, 10*ii*, 10*iii*, 10*iv*, 10*v*, 10*vi*, 10*vii*, 10*viii*, 10*ix* (i.e., to add and remove towels 62 from the device, and to position the device in different desired locations).

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A towel holding device configured to support a towel from an object, said towel holding device comprising:

an attachment mechanism, said attachment mechanism configured to attach said towel holding device to said object;

a towel holding member, said towel holding member configured to removably hold said towel in said towel holding device; and a housing portion, said towel holding member being disposed inside of said housing portion, said housing portion configured to be displaceable relative to said attachment mechanism and said towel holding member so that said towel is capable of being inserted into said towel holding device;

wherein said towel holding member is in a form of a tongue member, said tongue member including an upper cylindrical portion configured to be attached to said attachment mechanism and a lower base portion configured to engage said towel when said towel is being held in said towel holding device, said lower base portion of said tongue member flared outwardly relative to said upper cylindrical portion of said tongue member.

2. The towel holding device according to claim 1, wherein said attachment mechanism comprises an upper ring portion and a cylindrical base portion, said upper ring portion of said attachment mechanism configured to be attached to said object, and said cylindrical base portion of said attachment mechanism configured to be attached to said towel holding member.

3. The towel holding device according to claim 2, wherein said cylindrical base portion of said attachment mechanism is divided into two half sections such that an interior of said upper ring portion is capable of being accessed, thereby permitting said attachment mechanism to be wrapped around a portion of said object and said towel holding device to be secured to said object, said cylindrical base portion of said attachment mechanism further comprising a connecting projection extending outwardly from an outer surface of said cylindrical base portion, said connecting projection of said cylindrical base portion configured to be removably attached to a cavity disposed in said towel holding member in a snap-fit type engagement such that said attachment mechanism is capable of being selectively attached and detached from said towel holding member by a user, and said upper ring portion of said attachment mechanism comprising an elastically deformable material so that said upper ring portion is capable of being elastically deformed when said portion of said object is being inserted into said interior of said upper ring portion.

4. The towel holding device according to claim 2, wherein at least one portion of said upper ring portion of said attachment mechanism is separable from another portion of said upper ring portion such that an interior of said upper ring portion is capable of being accessed, thereby permitting said attachment mechanism to be wrapped around a portion of said object and said towel holding device to be secured to said object, and said upper ring portion of said attachment mechanism comprising a fastener member configured to removably attach said separable portions of said upper ring portion to one another.

5. The towel holding device according to claim 4, wherein said fastener member of said upper ring portion comprises one or more magnets for magnetically attaching said separable portions of said upper ring portion to one another, said one or more magnets configured to allow a detachment of said separable portions of said upper ring portion when a force exceeding a predetermined amount is applied to said towel so as to form a breakaway connection for preventing damage to said object to which said towel holding device is attached.

6. The towel holding device according to claim 1, wherein said attachment mechanism comprises a strap member attached to a cylindrical base portion, said strap member of said attachment mechanism configured to be attached to said object, and said cylindrical base portion of said attachment mechanism configured to be attached to said towel holding member, at least one portion of said strap member of said attachment mechanism being separable from another portion of said strap member such that an interior of said strap member is capable of being accessed, thereby permitting said attachment mechanism to be wrapped around a portion of said object and said towel holding device to be secured to said object, and said strap member of said attachment mechanism comprising one or more fastener members configured to removably attach said separable portions of said strap member to one another.

7. The towel holding device according to claim 1, wherein said attachment mechanism comprises an upper loop portion and a lower base portion, said upper loop portion of said attachment mechanism comprising a pair of spaced-apart downwardly extending arms, and said lower base portion of said attachment mechanism comprising a pair of spaced-apart upwardly extending arms that correspond to said downwardly extending arms of said upper loop portion, said downwardly extending arms of said upper loop portion configured to be removably attached to said upwardly extending arms of said lower base portion such that an interior of said upper loop portion is capable of being accessed, thereby permitting said attachment mechanism to be engaged with said object and said towel holding device to be secured to said object.

8. The towel holding device according to claim 7, wherein said upper loop portion of said attachment mechanism further comprises at least one release device coupled to one of said downwardly extending arms, said at least one release device configured to disengage said one of said downwardly extending arms of said upper loop portion from a respective one of said upwardly extending arms of said lower base portion so as to enable said interior of said upper loop portion to be accessed and said attachment mechanism to be engaged with said object.

9. The towel holding device according to claim 7, wherein said attachment mechanism of said towel holding device is provided with a plurality of interchangeable upper loop portions of different sizes so as to enable said towel holding device to be attached to different objects having various sizes.

10. The towel holding device according to claim 1, further comprising a spring-like mechanism, said spring-like mechanism being disposed proximate to said upper cylindrical portion of said tongue member, and said spring-like mechanism configured to bias said tongue member in an engaged position with said towel, and said tongue member comprising at least one tab member for supporting an end of said spring-like mechanism.

11. The towel holding device according to claim 1, wherein said housing portion comprises a front housing portion and a rear housing portion, at least one of said front housing portion and said rear housing portion comprising an aperture for receiving said towel therein.

12. The towel holding device according to claim 11, wherein each of said front housing portion and said rear housing portion comprises a respective aperture formed therein for allowing a passage of said towel through oppositely disposed sides of said towel holding device.

13. The towel holding device according to claim 11, wherein each of said front housing portion and said rear housing portion comprises an upper collar portion and a lower base portion, said lower base portion of each of said front and rear housing portions flared outwardly relative to said upper collar portion of each of said front and rear housing portions, and said lower base portions of said front and rear housing portions forming a substantially flat floor configured to hold said towel.

14. The towel holding device according to claim 13, wherein said substantially flat floor comprises a plurality of ribs spaced apart thereon for retaining said towel in said towel holding device.

15. The towel holding device according to claim 13, wherein said upper collar portion of at least one of said front and rear housing portions comprises an abutment configured to limit movement of said front and rear housing portions relative to said towel holding member.

16. A towel holding system comprising, in combination:

a towel; and a towel holding device supporting said towel from an object, said towel holding device including:

an attachment mechanism, said attachment mechanism configured to attach said towel holding device to said object;

a towel holding member, said towel holding member removably holding said towel in said towel holding device; and a housing portion, said towel holding member being disposed inside of said housing portion, said housing portion configured to be displaceable relative to said attachment mechanism and said towel holding member so that said towel is capable of being inserted into said towel holding device;

wherein said towel holding member of said towel holding device forms a breakaway connection with said towel so that, if a force exceeding a predetermined amount is applied to said towel, said towel is configured to be released from said towel holding member without damage being sustained to said towel holding device, said object, or an attachment site.

17. The towel holding system according to claim 16, wherein said attachment mechanism of said towel holding device is removably attached to said towel holding member of said towel holding device by means of a snap-fit type engagement.

18. The towel holding system according to claim 16, wherein said attachment mechanism of said towel holding device is configured to rotate 360 degrees relative to said towel holding member and said housing portion.

19. The towel holding system according to claim 16, wherein said towel holding device further comprises a spring-like mechanism; and wherein, when a downward force is applied to said housing portion by a user, said spring-like mechanism is configured to be compressed, and said housing portion is configured to be displaced relative to said attachment mechanism and said towel holding member.

20. The towel holding system according to claim 16, wherein said housing portion of said towel holding device comprises an elevated floor member disposed therein, said elevated floor member being spaced-apart from a bottom wall of said housing portion, and said towel holding member configured to rest against an upper surface of said elevated floor member.

21. The towel holding system according to claim 16, wherein said object to which said towel holding device is attached comprises one of: (i) a towel rod, (ii) a refrigerator handle, (iii) a cabinet handle, (iv) a cabinet knob, (v) a wall hook, (vi) an oven door, (vii) a microwave handle, (viii) a mirror, and (ix) a door knob.

22. The towel holding system according to claim 16, wherein said attachment mechanism of said towel holding device comprises a cylindrical attachment member and a suction cup base portion, said suction cup base portion configured to be attached to said object, and said cylindrical attachment member of said attachment mechanism configured to be coupled to said towel holding member.

23. The towel holding system according to claim 16, wherein said attachment mechanism of said towel holding device comprises an upper ring portion and a cylindrical base portion, said upper ring portion of said attachment mechanism configured to be attached to said object, and said cylindrical base portion of said attachment mechanism configured to be attached to said towel holding member; and wherein at least one portion of said upper ring portion of said attachment mechanism is separable from another portion of said upper ring portion such that an interior of said upper ring portion is capable of being accessed, thereby permitting said attachment mechanism to be wrapped around a portion of said object and said towel holding device to be secured to said object.

24. A towel holding device configured to support a towel from an object, said towel holding device comprising:

an attachment mechanism, said attachment mechanism configured to attach said towel holding device to said object, said attachment mechanism comprising an upper loop portion and a lower base portion, said upper loop portion of said attachment mechanism comprising a pair of spaced-apart downwardly extending arms, and said lower base portion of said attachment mechanism comprising a pair of spaced-apart upwardly extending arms that correspond to said downwardly extending arms of said upper loop portion, said downwardly extending arms of said upper loop portion configured to be removably attached to said upwardly extending arms of said lower base portion such that an interior of said upper loop portion is capable of being accessed, thereby permitting said attachment mechanism to be engaged with said object and said towel holding device to be secured to said object;

a towel holding member, said towel holding member configured to removably hold said towel in said towel holding device; and a housing portion, said towel holding member being disposed inside of said housing portion, said housing portion configured to be displaceable relative to said attachment mechanism and said towel holding member so that said towel is capable of being inserted into said towel holding device.

25. The towel holding device according to claim 24, wherein said upper loop portion of said attachment mechanism further comprises at least one release device coupled to one of said downwardly extending arms, said at least one release device configured to disengage said one of said downwardly extending arms of said upper loop portion from a respective one of said upwardly extending arms of said lower base portion so as to enable said interior of said upper loop portion to be accessed and said attachment mechanism to be engaged with said object, said at least one release device configured to allow a detachment of said upper loop portion from said lower base portion when a force exceeding a predetermined amount is applied to said towel so as to form a breakaway connection for preventing damage to said object to which said towel holding device is attached.

* * * * *